US010690315B2

(12) United States Patent
Lowes et al.

(10) Patent No.: US 10,690,315 B2
(45) Date of Patent: Jun. 23, 2020

(54) LUMINAIRE UTILIZING GASKET VENT

(71) Applicant: Ideal Industries Lighting LLC, Durham, NC (US)

(72) Inventors: Theodore D. Lowes, Lompoc, CA (US); Chandan Bhat, Goleta, CA (US); Mark Youmans, Goleta, CA (US)

(73) Assignee: Ideal Industries Lighting LLC, Sycamore, IL (US)

( * ) Notice: Subject to any disclaimer, the term of this patent is extended or adjusted under 35 U.S.C. 154(b) by 0 days.

(21) Appl. No.: 16/034,101

(22) Filed: Jul. 12, 2018

(65) Prior Publication Data

US 2019/0162384 A1 May 30, 2019

Related U.S. Application Data

(60) Provisional application No. 62/531,747, filed on Jul. 12, 2017.

(51) Int. Cl.

| | |
|---|---|
| ***F21V 29/00*** | (2015.01) |
| ***F21S 45/30*** | (2018.01) |
| ***F21V 15/04*** | (2006.01) |
| ***F21V 31/00*** | (2006.01) |
| ***F21V 31/03*** | (2006.01) |
| *F21W 131/10* | (2006.01) |

(52) U.S. Cl.
CPC ..... *F21S 45/30* (2018.01); *F21V 15/04* (2013.01); *F21V 31/005* (2013.01); *F21V 31/03* (2013.01); *F21W 2131/10* (2013.01)

(58) Field of Classification Search
CPC ..... F21S 45/30; F21V 15/04; F21V 31/005; F21V 31/03
See application file for complete search history.

(56) References Cited

U.S. PATENT DOCUMENTS

2014/0268830 A1* 9/2014 Boyer ..... F21V 21/14 362/382

* cited by examiner

*Primary Examiner* — Matthew J. Peerce
(74) *Attorney, Agent, or Firm* — Myers Bigel, P.A.

(57) ABSTRACT

According to one example aspect, a device for venting a luminaire compartment comprises a luminaire compartment disposed between first and second luminaire components and one or more luminaire gaskets maintaining a weatherproof seal about the luminaire compartment. The device further comprises one or more venting tubes traversing the one or more luminaire gaskets such that the one or more venting tubes extend into the luminaire compartment and the one or more venting tubes equalize one or more environmental parameters of the luminaire compartment with one or more environmental parameters of the ambient environment.

19 Claims, 24 Drawing Sheets

LUMINAIRE UTILIZING GASKET VENT

CROSS REFERENCE TO RELATED APPLICATIONS

The present application claims the benefit of U.S. Provisional Patent Application No. 62/531,747, filed Jul. 12, 2017, entitled "Luminaire Utilizing Gasket Vent", which is owned by the assignee of the present application and the disclosure of which is hereby incorporated by reference herein.

TECHNICAL FIELD

The present subject matter relates to general illumination lighting, and more particularly, arrangements for weather-proofing luminaires utilized to provide general illumination lighting.

BACKGROUND

Large areas of open space, such as a farm stead, a parking lot or deck of a parking garage, or a roadway, require sufficient lighting to allow for safe travel of vehicles and persons through the space at all times including periods of reduced natural lighting, such as nighttime, rainy, or foggy weather conditions. A luminaire for rural areas, an outdoor parking lot or covered parking deck, a roadway, etc. must illuminate a large area of space in the vicinity of the luminaire while controlling glare so as not to distract drivers. In some applications such as roadway, street, or parking lot lighting, it may be desirable to illuminate certain regions surrounding a light fixture while maintaining relatively low illumination of neighboring regions thereof. For example, along a roadway, it may be preferred to direct light in a lateral direction parallel with the roadway while minimizing illumination in a longitudinal direction toward roadside houses or other buildings. Still further, such a luminaire should be universal in the sense that the luminaire can be mounted in various enclosed and non-enclosed locations, on poles or on a surface (such as a garage ceiling), and preferably present a uniform appearance.

Advances in light emitting diode (LED) technology have resulted in wide adoption of luminaires that incorporate such devices. While LEDs can be used alone to produce light without the need for supplementary optical devices, it has been found that optical modifiers, such as lenses, reflectors, optical waveguides, and combinations thereof, can significantly improve illumination distribution for particular applications. Improved consistency in the manufacture of LEDs along with improvements in the utilization of mounting structures to act as heat sinks have resulted in luminaires that are economically competitive and operationally superior to the conventional incandescent and fluorescent lighting that has been the staple of the industry for decades. As the use of LEDs has matured from their use in warning and other signals to general lighting fixtures, it has become necessary to develop optics that allow for the dispersion of the harsh, intensely concentrated beam of light emitted by the LED into a softer, more comfortable illumination that presents a uniform and even appearance. One way of attaining a more uniform appearance is to control the light rays generated by the LEDs so as to redirect the light rays through and/or out of an optic so that the light presents a uniform appearance when it exits the optic. Redirecting light through the optic can be accomplished through the use of refractive surfaces at a refractive index interface.

The numerous locations and the environmental disparities therebetween have led to sealing and weather-proofing techniques for LED luminaires. Sealing and weather-proofing is useful to protect LEDs, LED driver circuitry, control circuitry, sensors, other circuitry, and/or other sensitive components of the luminaire. Sometimes sealing and weather-proofing techniques result in volumes within luminaires becoming susceptible to damage resulting from pressure, temperature, and humidity differences between one or more volumes within the luminaires and/or the outside environment.

One practice for equalizing environmental parameters between luminaire compartments utilizes a plug with a gas permeable membrane, such as Gore-Tex® brand material or another suitable membrane material, disposed therein. Such a plug provides for pressure equalization across an otherwise air-tight gasket, however, plugs of this type may add expense and are susceptible to clogging. An improved method and arrangement for providing vent(s) and/or venting of one or more volumes within luminaire(s) is desirable within the field of LED lighting.

SUMMARY

According to one example aspect, a device for venting a luminaire compartment comprises a luminaire compartment disposed between first and second luminaire components and one or more luminaire gaskets maintaining a weather-proof seal about the luminaire compartment. The device further comprises one or more venting tubes traversing the one or more luminaire gaskets such that the one or more venting tubes extend into the luminaire compartment and the one or more venting tubes equalize one or more environmental parameters of the luminaire compartment with one or more environmental parameters of the ambient environment.

According to another example aspect, a method for providing a vent for one or more luminaire compartments comprises positioning one or more weather-proof gaskets about one or more compartments of a luminaire such that the one or more weather-proof gaskets prevent environmental debris from entering the one or more luminaire compartments. The method also comprises forming one or more tubes comprising one or more respective pointed ends, piercing the one or more weather-proof gaskets with at least one of the one or more pointed ends of the one or more tubes, and inserting the one or more tubes through the one or more weather-proof gaskets. Further in accordance with this aspect, the one or more tubes remain disposed through the one or more weather-proof gaskets after piercing therethrough, and passage of air is provided between the one or more luminaire compartments and another one or more luminaire compartments so that the one or more luminaire compartments adjust to ambient environmental conditions.

According to yet another example aspect, a system for weather-proofing a light fixture comprises a gasket formed from a curable polymer dispensed about a perimeter of a first volume within a light fixture and one or more tubes and one or more other electrical components disposed across the perimeter of the first volume about which the curable polymer is dispensed. Additionally, the one or more tubes may extend into the first volume and into a second volume wherein the second volume comprises ambient environmental conditions, and the one or more tubes may extend a length out from the gasket such that a likelihood that an opening of the one or more tubes encounters environmental debris is decreased.

According to yet another example aspect, a system for weather-proofing a luminaire comprises a gasket formed from curable polymer dispensed about a perimeter of a first volume within the luminaire, and a tube disposed across the perimeter of the first volume about which the curable polymer is dispensed wherein one or more luminaire components are disposed within the tube and traverse the gasket through the tube, and further wherein conditions within the first volume are equalized with the ambient environmental conditions by passage of air through the tube and about the one or more other luminaire components disposed therein.

Other aspects and advantages of the present disclosure will become apparent upon consideration of the following detailed description and the attached drawings wherein like numerals designate like structures throughout the specification.

DETAILED DESCRIPTION

Figure 1:
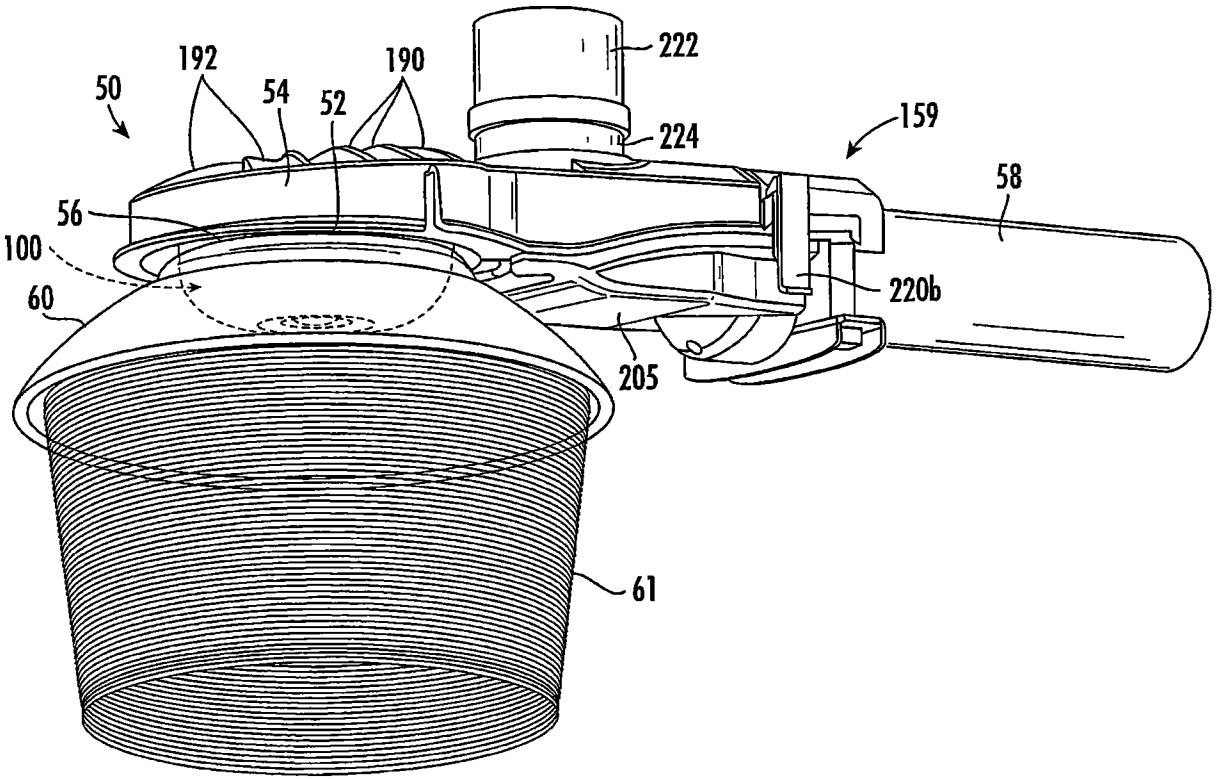
FIG. 1 is an isometric view taken from below of a luminaire incorporating an optical member.
Figure 1A:
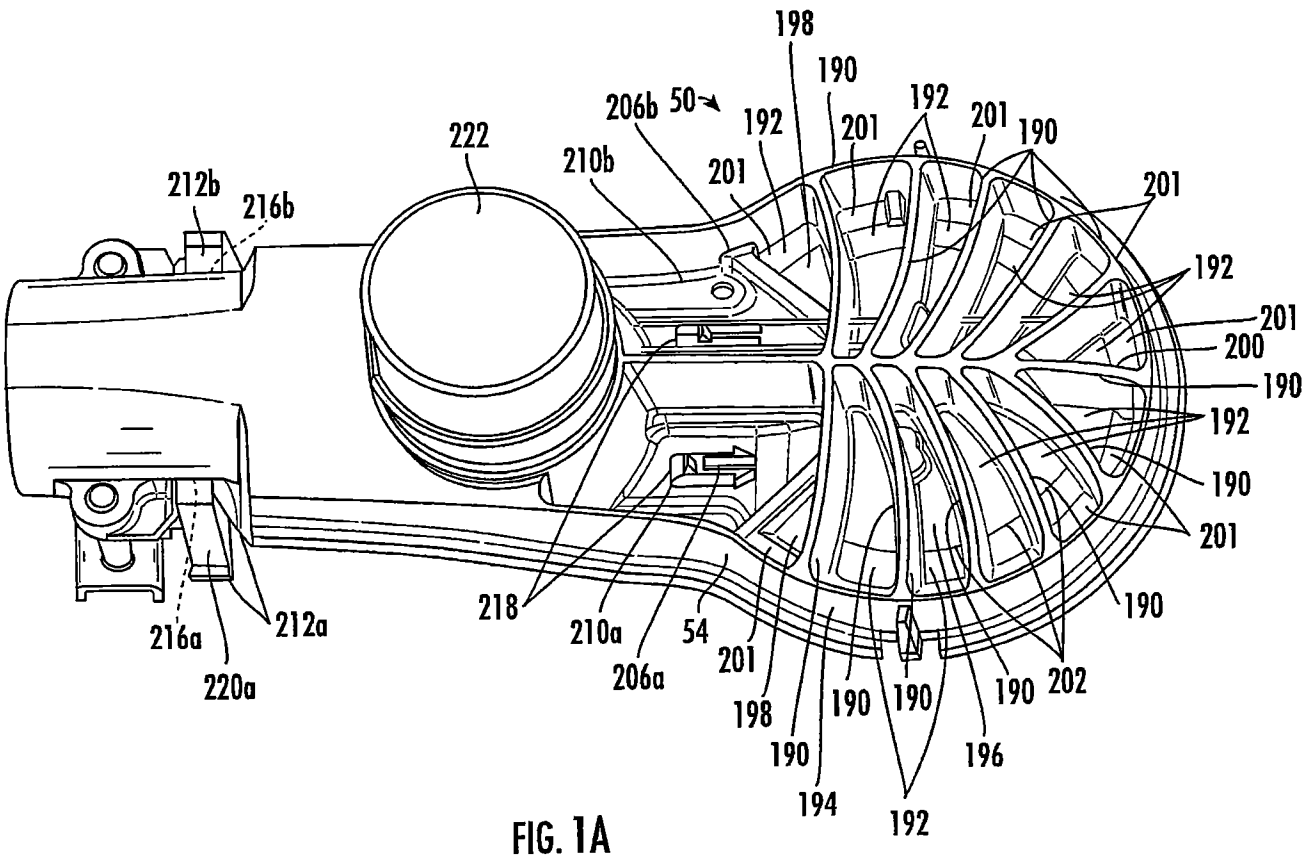
FIG. 1A is an isometric view taken from above of the luminaire of FIG. 1.
Figure 2:
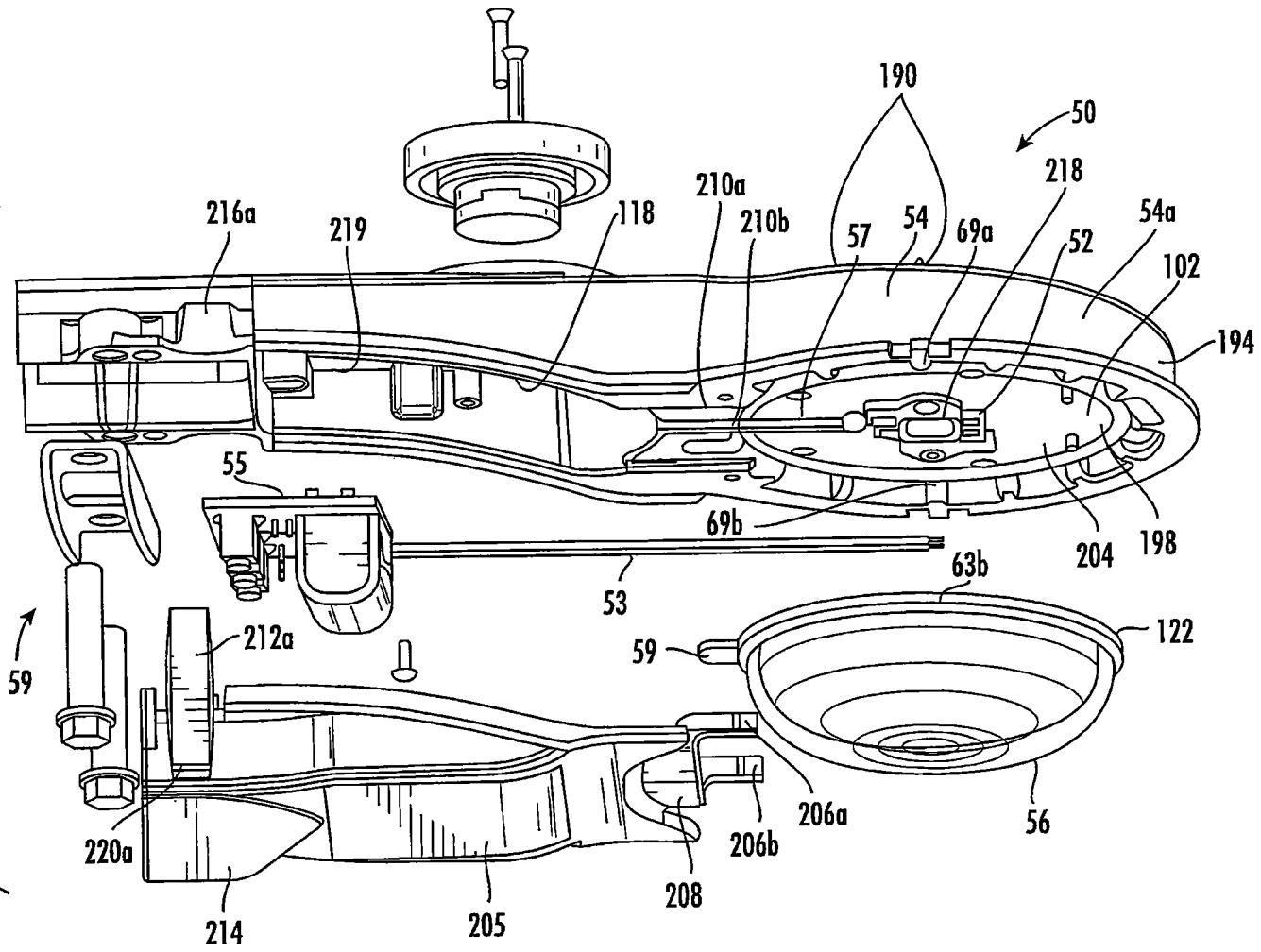
FIG. 2 is an exploded isometric view taken from below of a luminaire incorporating an optical member.

Disclosed herein is a gasket vent 104 for use with a luminaire 50 for general lighting, such as illumination of an open or large enclosed space, for example, in a rural setting, a roadway, a parking lot or structure, or the like. Referring to FIGS. 1, 1A, and 2, the luminaire 50 includes a light source such as one or more LED element(s) or module(s) 52 disposed in a housing 54 having a transparent optical member 56 and a cover 205 secured thereto. The luminaire 50 is adapted to be mounted on a device or structure, for example, on an outdoor pole or stanchion 58 and retained thereon by a clamping apparatus 159. The luminaire 50 may further include an optional reflector 60 and/or an optional shroud 61 secured in any suitable fashion about the optical member 56. The luminaire 50 may also include an ambient light sensor 222 mounted in a receptacle 224 that acts as a switch such that, when the level of ambient light drops below a predetermined threshold, an electrical path is established by the sensor 222 thereby causing the luminaire 50 to illuminate.

Each LED element or module 52 may be a single white or other color LED chip or other bare component, or each may comprise multiple LEDs either mounted separately or together on a single substrate or package to form a module including, for example, at least one phosphor-coated LED either alone or in combination with at least one color LED, such as a green LED, a yellow LED, a red LED, etc. In those cases where a soft white illumination with improved color rendering is to be produced, each LED element or module 52 or a plurality of such elements or modules 52 may include one or more blue shifted yellow LEDs and one or more red LEDs. The LEDs may be disposed in different configurations and/or layouts as desired. Different color temperatures and appearances could be produced using other LED combinations, as is known in the art. In one embodiment, each element or module comprises any LED, for example, an MT-G LED incorporating TrueWhite® LED technology or as disclosed in U.S. patent application Ser. No. 13/649,067, filed Oct. 10, 2012, entitled "LED Package with Multiple Element Light Source and Encapsulant Having Planar Surfaces" by Lowes et al., the disclosure of which is hereby incorporated by reference herein, as developed and manufactured by Cree, Inc., the assignee of the present application. If desirable, a side emitting LED disclosed in U.S. Pat. No. 8,541,795, filed Oct. 10, 2005, entitled "Side-Emitting Optical Coupling Device" by Keller et al., the disclosure of which is hereby incorporated by reference herein, as developed and manufactured by Cree, Inc., the assignee of the present application, may be utilized. In some embodiments, each LED element or module 52 may comprise one or more LEDs disposed within a coupling cavity with an air gap being disposed between the LED element or module 52 and a light input surface. In any of the embodiments disclosed herein each of the LED element(s) or module(s) 52 preferably have a lambertian or near-lambertian light distribution, although each may have a directional emission distribution (e.g., a side emitting distribution), as necessary or desirable. More generally, any lambertian, symmetric, wide angle, preferential-sided, or asymmetric beam pattern LED element(s) or module(s) may be used as the light source.

Figure 2A:
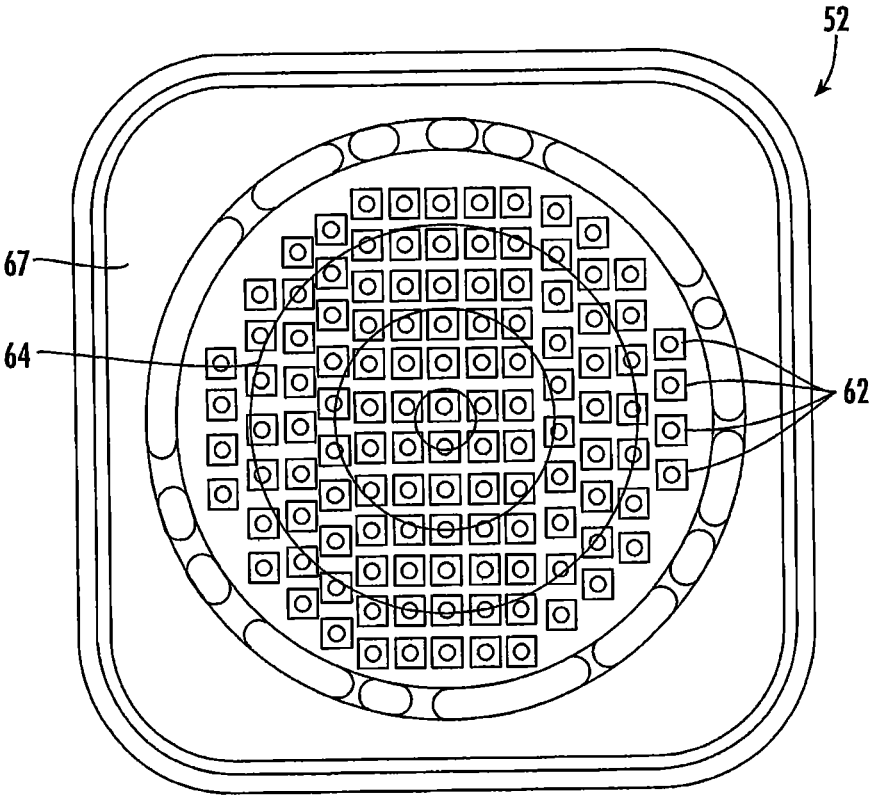
FIG. 2A is a bottom elevational view of an LED element or module.
Figure 3:
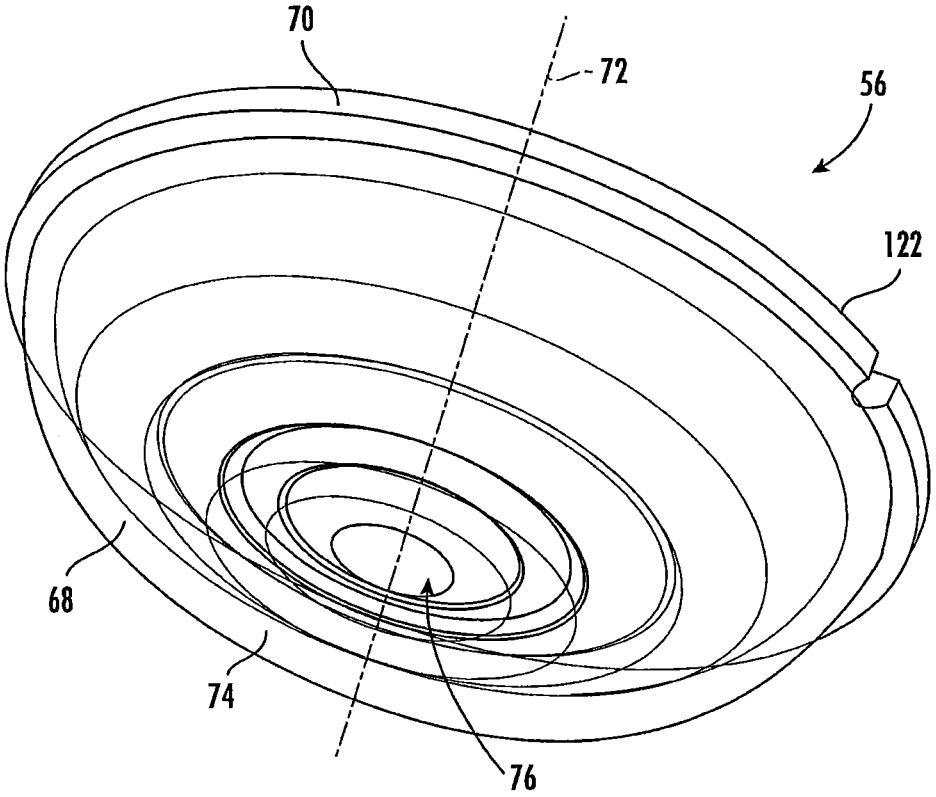
FIG. 3 is an isometric view from below of an embodiment of an optic.

In one embodiment, the LED package or element 52 may comprise a multi-die LED package, as shown in FIG. 2A. The multi-die package includes at least 40 dies 62 disposed under a single encapsulant or other primary optic 64 on a circuit board 67. In other embodiments, the multi-die package may include 80 dies, or 120 dies, or any number of dies as desired. The optical member 56 may be used with a relatively large LED package having a diameter from about 12.5 mm to about 30 mm, preferably from about 17.5 mm to about 25 mm. In one embodiment, the lighting device 50 may include a module or element as disclosed in co-pending U.S. Patent Application 62/088,375, filed Dec. 5, 2014, entitled "Voltage Configurable Solid State Lighting Apparatuses, Systems, and Related Methods", the disclosure of which is hereby incorporated by reference herein, as developed and manufactured by Cree, Inc., the assignee of the present application. In other embodiments, the LED package may include a plurality of individual LED dies wherein each die has an associated encapsulant. The electrical components of the luminaire 50 are described in greater detail in co-pending U.S. patent application Ser. No. 14/618,819, entitled "LED Luminaire,", filed Feb. 10, 2015, owned by the assignee of the present application, and the disclosure of which is hereby incorporated by reference hereinabove.

Referring to FIGS. 1, 1A, and 2, the housing 54 includes a plurality of tapered fins 190, a plurality of cavities 192 adjacent and between the fins 190, and an outer wall 194 surrounding the fins 190 and the cavities 192 to provide thermal management of the LED element or module 52. Specifically, the outer wall 194 of the housing 54 is disposed about and at least partially surrounds a first surface 196 of a base 198 (seen in FIGS. 2, 7, 8, 16, and 17). Each fin 190 extends between a tapered central wall 200 and the outer wall 194. Each cavity 192 extends into an associated space 201 between an outer edge 202 of the first surface 196 and the outer wall 194 and between adjacent fins 190. Each space 201 comprises a void or flow through channel that allows convective air flow therethrough for cooling purposes, and further allows fluid flow to drain rainwater. The first surface 196 slopes to the outer edge 202 such that a thickness of the base 198 near the central wall 200 is greater than a thickness of the base 198 near the outer edge 202 thereof to promote water drainage. The LED element or module 52 is mounted on a second surface 204 of the base 198 opposite the first surface 196. During operation, heat is dissipated as air flow carries heat produced by the LED element or module 52 through the spaces 201 and cavities 192 and along the surfaces of the fins 190, the outer wall 194, and the central wall 200. Other heat dissipation means may also be used. Alternatively or additionally, the outer wall 194 may be square or rectangular or some other shape, and/or the sizes and/or shapes of the cavities and/or the spaces 201 may be varied, as desired. One or more of the fins 190, the outer wall 194, and/or the base 198 may be continuous or discontinuous. Preferably, the fins 190, the outer wall 194, the base 198, and the other elements of the housing 154 are made of uncoated aluminum or another suitable material and are integrally formed.

In the embodiment illustrated in FIGS. 1 and 2, the cover 205 attaches to the housing 54 without the need for separate fastening components. As shown in FIG. 2, first and second prongs 206*a*, 206*b* extending from a first end 208 of the cover 205 are received by first and second openings 210*a*, 210*b* in the housing 54. First and second tabs 212*a*, 212*b* extending from a second end 214 of the cover 205 opposite the first end 208 include first and second protrusions 213*a*, 213*b*, respectively, that snap-fit about respective first and second ledges 216*a*, 216*b* of the housing 54. During assembly and installation, the first and second prongs 206*a*, 206*b* of the cover 205 are inserted into the first and second openings 210*a*, 210*b* of the housing 54 and the cover is allowed to hang freely from the prongs 206 and yet be movable about an axis of rotation 218. Thereafter, wires may be attached to components in a compartment 219 (seen in FIG. 2) as the cover 205 is hanging freely from the housing 54. Once connections have been made, the cover 205 may be pivoted about the axis of rotation 218 until the first and second tabs 212*a*, 212*b* of the cover 205 snap over the first and second ledges 216*a*, 216*b* of the housing 54. To remove the cover 205, first and second surfaces 220*a*, 220*b* opposite first and second tabs 212*a*, 212*b*, respectively, may be pushed together such that the first and second tabs 212*a*, 212*b* are moved from interfering relationship with the first and second ledges 216*a*, 216*b* of the housing 54 and the cover 205 may be pivoted about the point of rotation 218. In other embodiments, additional fastening components such as screws and/or pins may be used to secure the cover 205 to the housing 54.

Referring to FIG. 2, the optical member or enclosure 56 is disposed about the LED package(s) or element(s) 52 to produce a desired light distribution having a desired lumen output level. The material(s) of the optical member 56 preferably comprises optical grade materials that exhibit refractive characteristics such as glass and/or polycarbonate, although other materials such as acrylic, air, molded silicone, and/or cyclic olefin copolymers, and combinations thereof, may be used. Further, the materials may be provided in a layered arrangement to achieve a desired effect and/or appearance. Preferably, although not necessarily, the optical member 56 is solid, although the optical member 56 may have one or more voids or discrete bodies of differing materials therein. The optical member 56 may be fabricated using procedures such as molding, including glass and/or injection/compression molding, or hot embossing, although other manufacturing methods such may be used as desired. In one embodiment, the optical member 56 comprises glass and is manufactured using glass molding techniques. Additional details of the luminaire 50 are described in greater detail in co-pending U.S. patent application Ser. No. 14/618,884, entitled "LED Luminaire and Components Therefor", filed Feb. 10, 2015, owned by the assignee of the present application, and the disclosure of which is hereby incorporated by reference hereinabove.

During assembly of the luminaire 50, the circuit board 67 of the LED package 52 is mounted by any suitable means, such as a bracket with fasteners and/or an adhesive material on the second surface 204 of the housing 54, and the optical member 56 is secured to the housing 54 about the LED package 52 by any suitable means, such as a UV curable silicone adhesive and/or another suitable adhesive. In an example embodiment shown in FIGS. 2, and 5-9, UV curable silicone adhesive, another suitable adhesive, and/or another suitable curable polymer (adhesive or non-adhesive) is dispensed as a liquid about an interior perimeter 102 of the housing 54 to form a gasket 108 (shown in detail in FIGS.

7-9, specifically). Wires 53 extend along and inside a channel 57 formed in the housing 54 and connect the LED package 52 to a further circuit board 55 located outside of the optical member 56 and disposed within the cover 205 of the housing 54.

Figure 5:
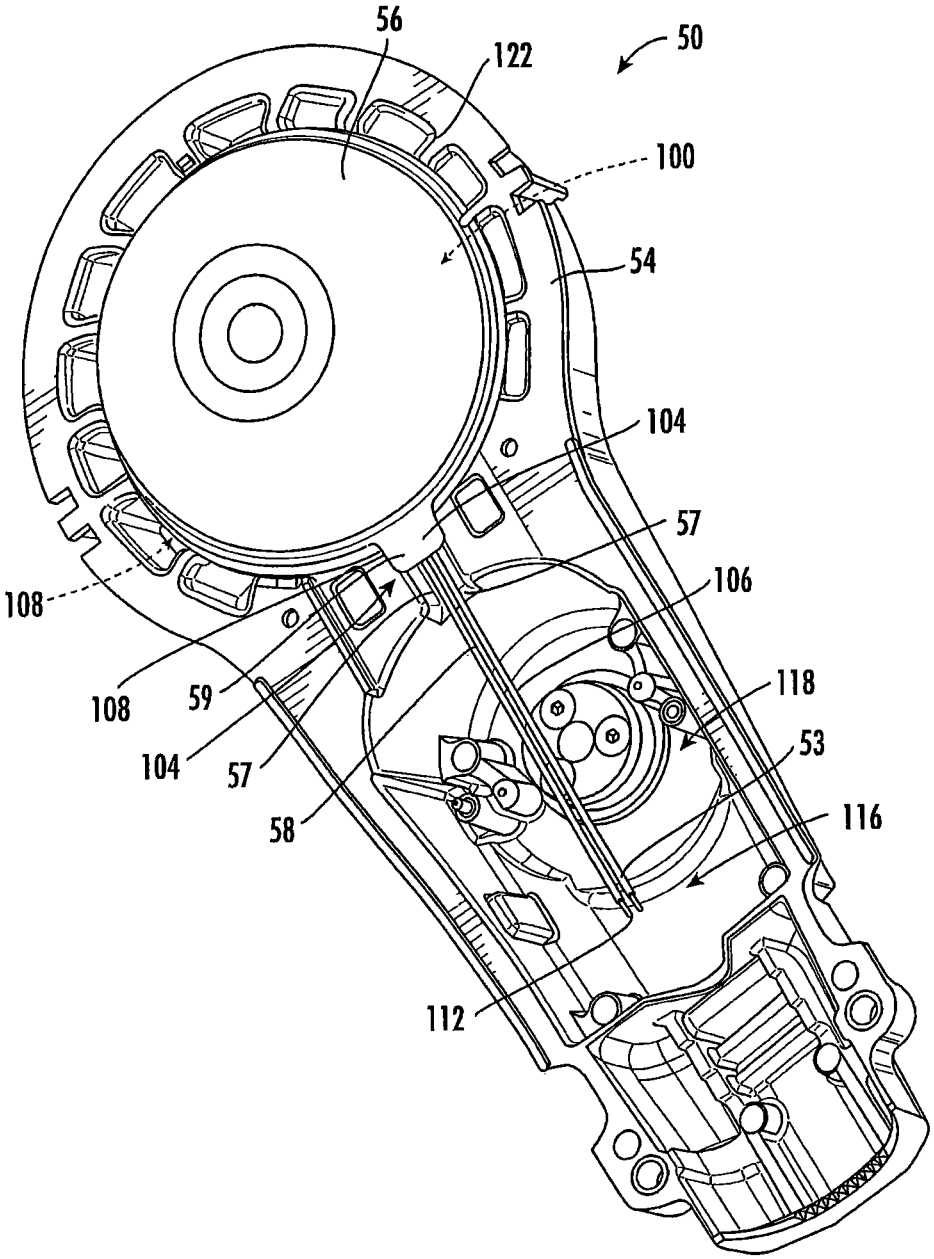
FIG. 5 is an isometric view taken from below of the luminaire of FIG. 1 with a cover omitted.
Figure 6:
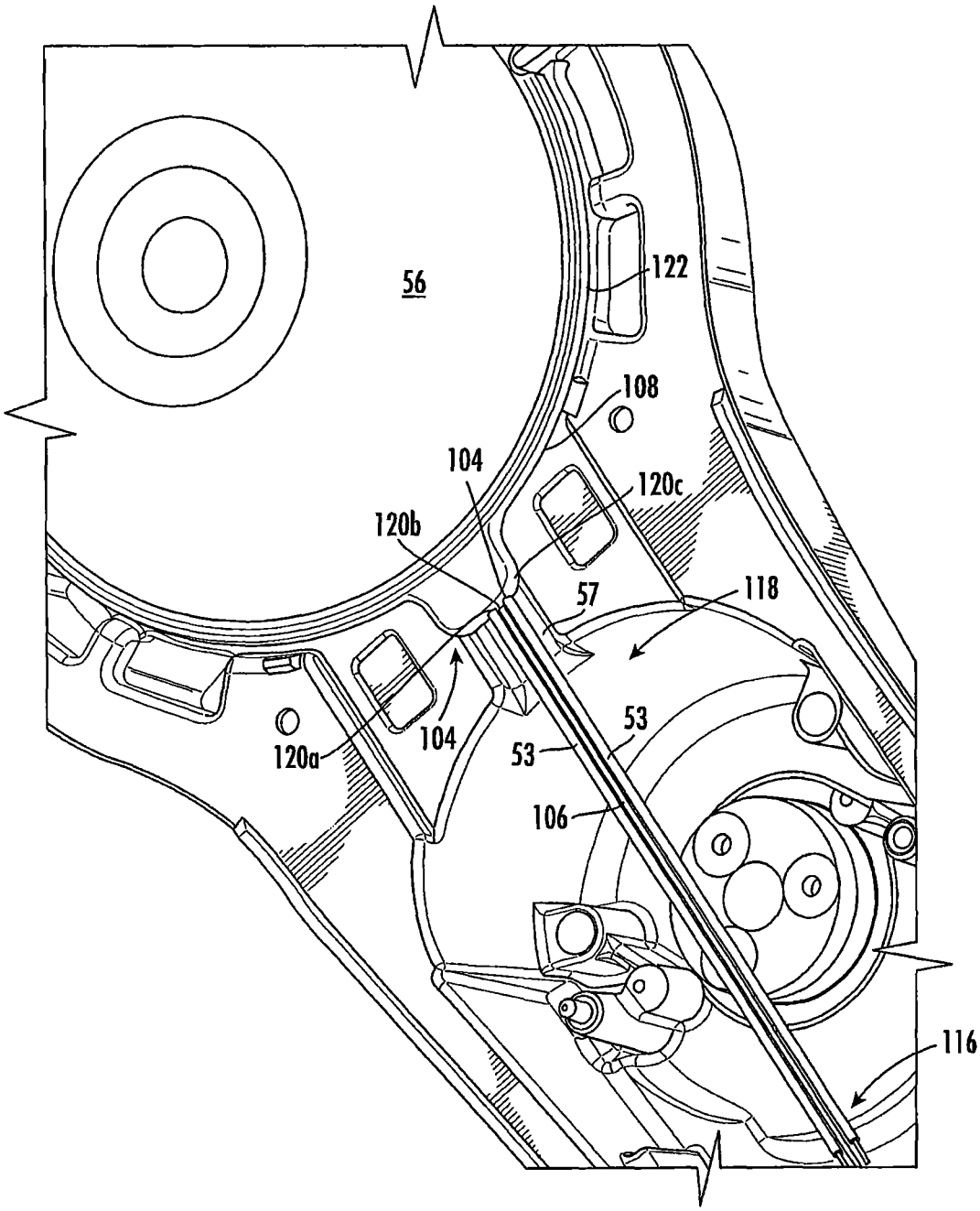
FIG. 6 is a partial enlarged isometric view taken from below of the luminaire of FIG. 1.

Further in the depicted example, the gasket vent 104 is arranged along the inside channel 57 between the one or more wires 53. The assembly of the luminaire 50 as depicted in FIGS. 5 and 6, illustrated with the cover 205 omitted, may provide a weather-proof and/or water-tight volume/compartment 100 within the optical member 56 and the housing 54 whereto the optical member 56 is attached and sealed by the gasket 108 formed from UV curable silicone adhesive or another suitable material for creating a weather-proof seal. It may be desirable to provide venting for the volume 100 so that variation in the ambient environment outside the luminaire 50, e.g. changes in temperature and/or pressure, is less likely to cause pressure and/or other parameter differential fluctuations between the luminaire compartment/volume 100 and ambient conditions while maintaining other weather-proof qualities of the seal, e.g. water-tightness.

The gasket vent 104 comprises a tube 106 disposed between the wires 53 such that the tube 106 and wires 53 both traverse the gasket 108 at points 120*a*, 120*b*, 120*c*. The tube 106 may be hollow or otherwise allow the passage of air therethrough. In the illustrated exemplary embodiment the tube 106 has an extent arranged substantially parallel to the wires 53 and first and second openings 110, 112 at respective first and second ends 114, 116 thereof. The first end 114 of the tube 106 extends into the volume 100 while the second end 116 of the tube 106 extends into another compartment of the luminaire 50 and/or outside the luminaire 50. In this example embodiment, the second end 116 of the tube 106 extends partially into a second volume/compartment 118 formed between the cover 205 and the housing 54. An internal diameter of the tube 106 is preferably about 250 micrometers, but may range from about 1.0 millimeters to about 50 micrometers.

Figure 4:
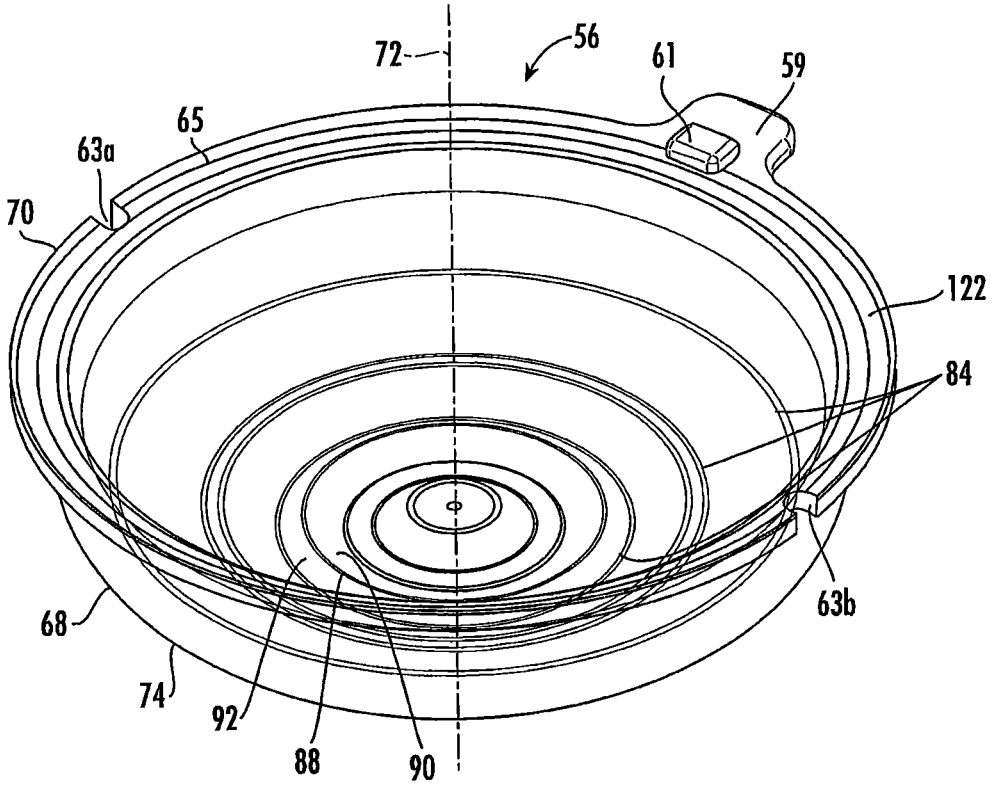
FIG. 4 is an isometric view from above of the embodiment of FIG. 3.
Figure 7:
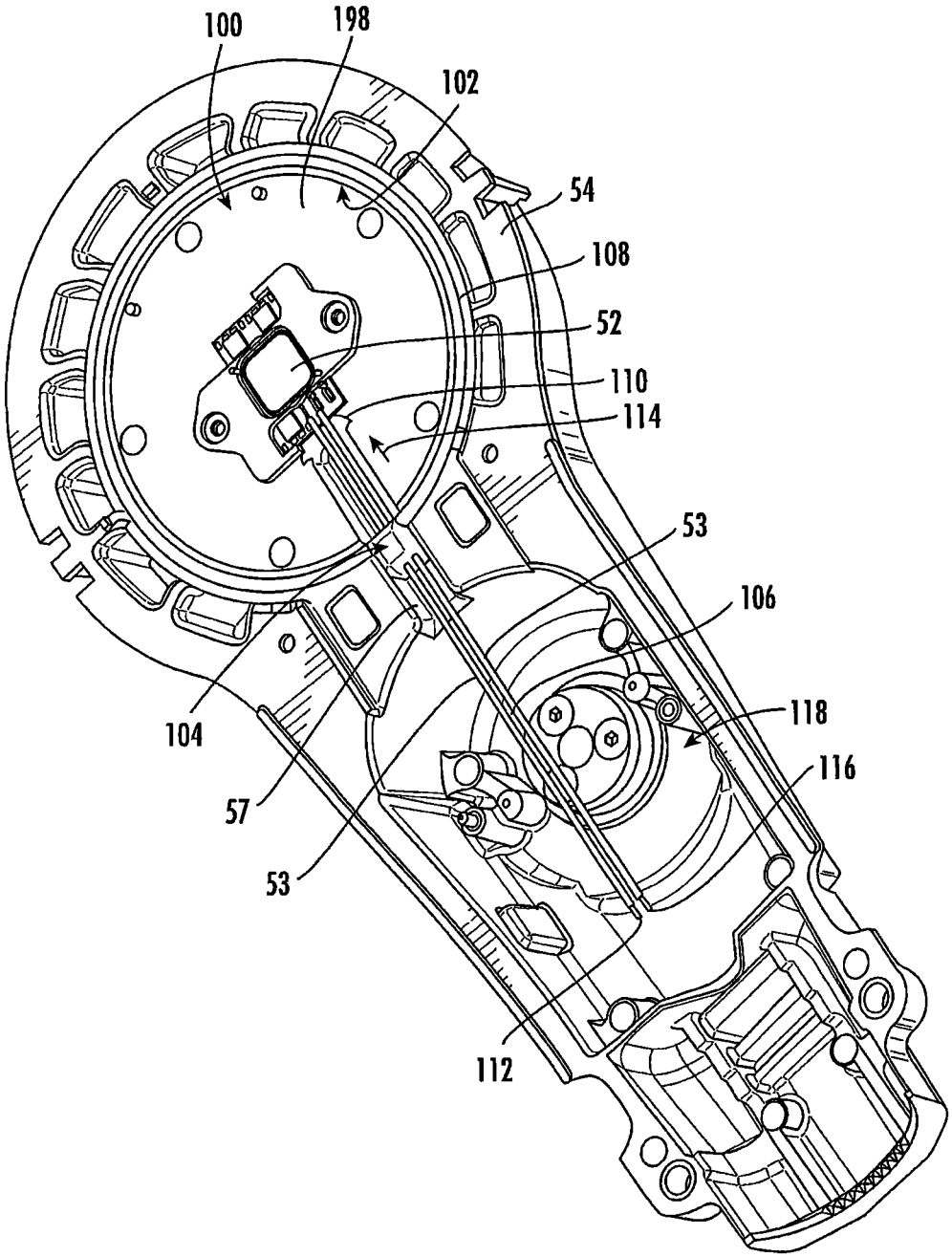
FIG. 7 is an isometric view taken from below of the luminaire of FIG. 1 with the cover and the optical member omitted so that a gasket and gasket vent assembly are shown.
Figure 8:
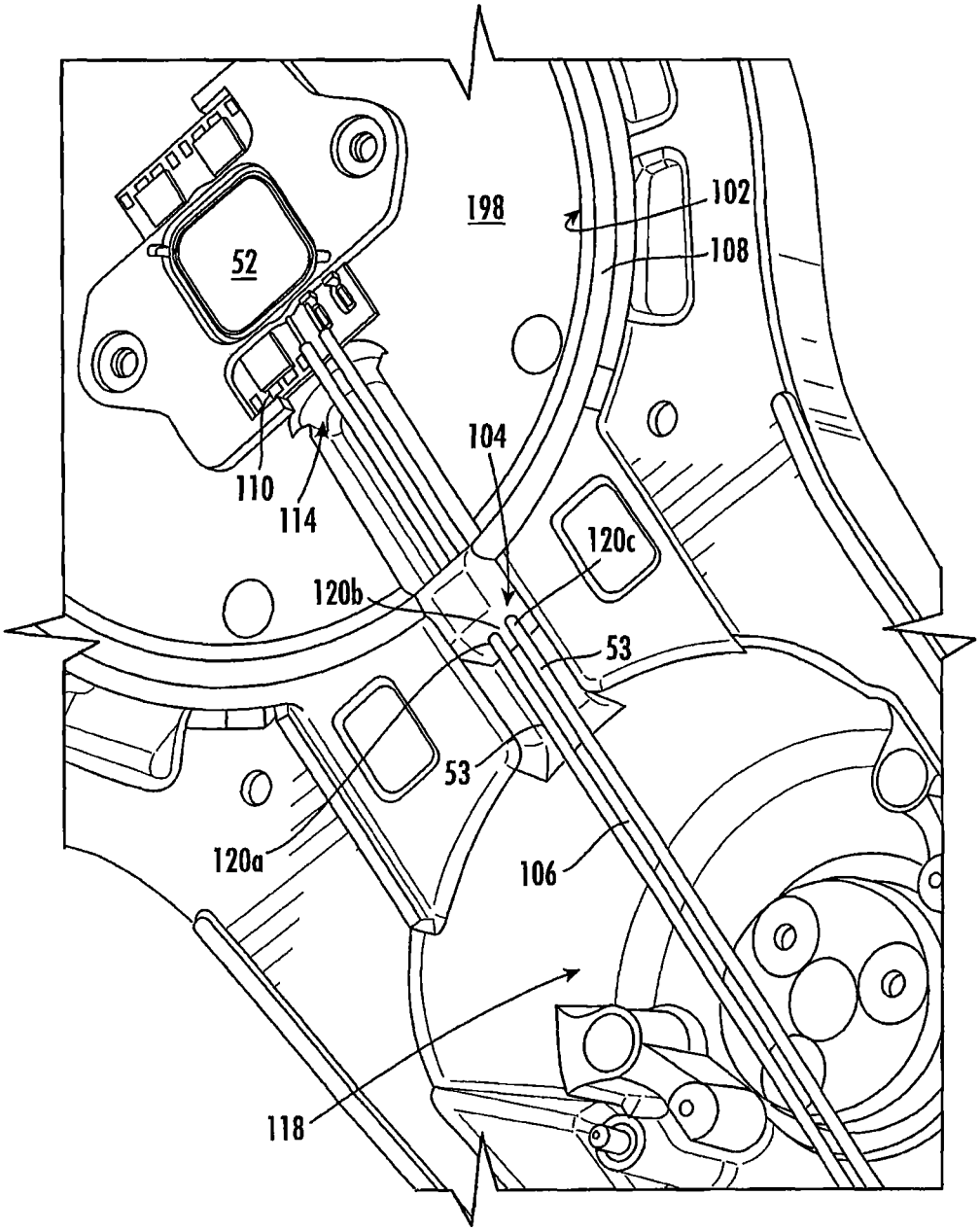
FIG. 8 is a partial enlarged isometric view taken from below of the luminaire of FIG. 7 showing the gasket and gasket vent assembly thereof.
Figure 9:
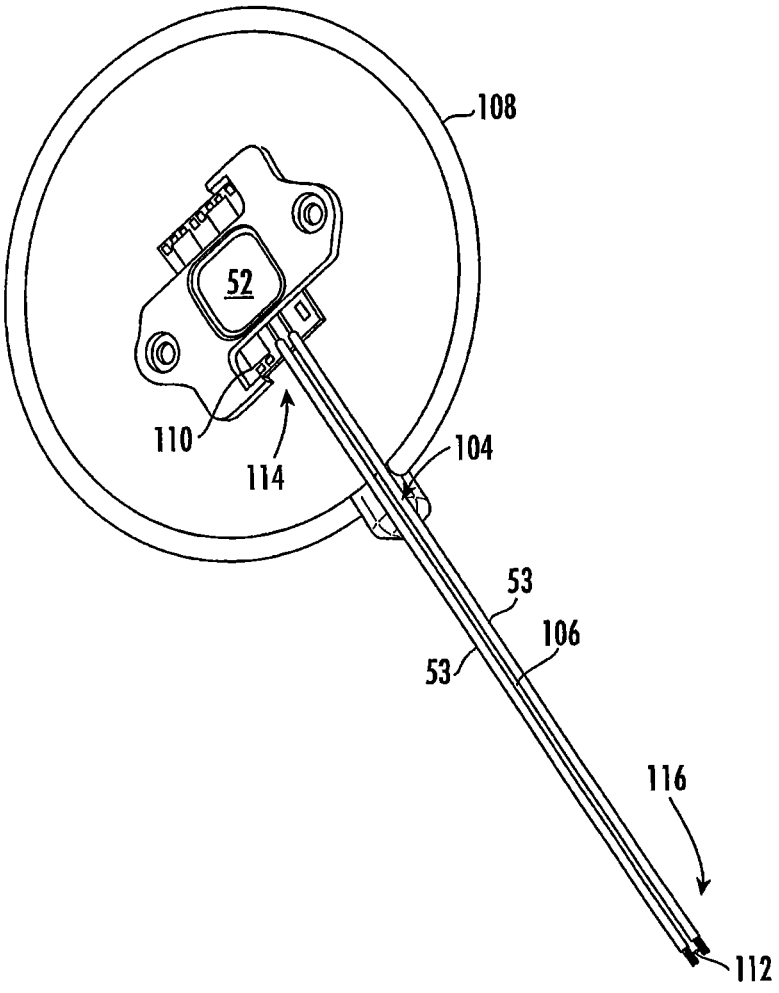
FIG. 9 is an isometric view of the gasket and gasket vent assembly shown in FIGS. 7 and 8.

As seen in FIGS. 7-8, as the UV curable silicone adhesive is dispensed as a liquid about the interior perimeter 102 of the second surface 204 of the housing 54 and the tube 106 and wires 53 are retained within the channel 57 such that the silicone adhesive surrounds the tube 106 and wires 53 to form a seal around the tube 106 and wires 53. The gasket 108 also seals the interior perimeter 102 of the housing 54 with an exterior perimeter 122 of the optical member 56 (FIG. 4). Therefore, the volume 100 is vented by the tube 106 while a weather-proof seal is maintained elsewhere about the volume 100. Air passes through the gasket 108 by way of the tube 106 to equalize the pressure, temperature, and/or other environmental conditions in the luminaire volume/compartment 100 as compared with the luminaire volume/compartment 118 within the cover 205 and/or the remainder of luminaire 50. The volume 118 and/or the remainder of the luminaire 50 may be protected from outside environmental conditions, but not fully sealed with respect to the ambient environment. Therefore, the conditions in the volume 100 may be equalized with respect to the ambient environment by way of the operative connection to the volume 118. FIG. 9 illustrates the gasket 108 and gasket vent 104, as formed by the UV curable silicone adhesive dispense about the interior perimeter 102 of the housing 54 described hereinabove, removed from the housing 54 and optical member 56.

Referring once again to FIGS. 4-6, the optical member 56 includes a tab 59 outwardly extending from the base 70 that is positioned over the wires 53 disposed in the channel 57. A stub 61 extending from the base 70 adjacent the tab 59 applies pressure to the gasket 108 disposed around the wires 53 in the channel 57 when the luminaire 50 is assembled. The tab 59 and stub 61 protect the tube 106, the wires 53, and the channel 57 from elements such as water and/or dust as well as mechanical damage. Surfaces defining two locating slots 63*a*, 63*b*, each having a semi-circular cylindrical shape, are disposed along an outer edge 65 of the base 70 opposite to one another and equidistant from the tab 59. The locating slots 63*a*, 63*b* receive protrusions 69*a*, 69*b* (FIG. 2) extending from the second surface 204 of the housing 54. The gasket 108 in combination with the tab 59, the stub 61, and the locating slots 63*a*, 63*b* secure and seal the optical member 56 to the housing 54.

Figure 10:
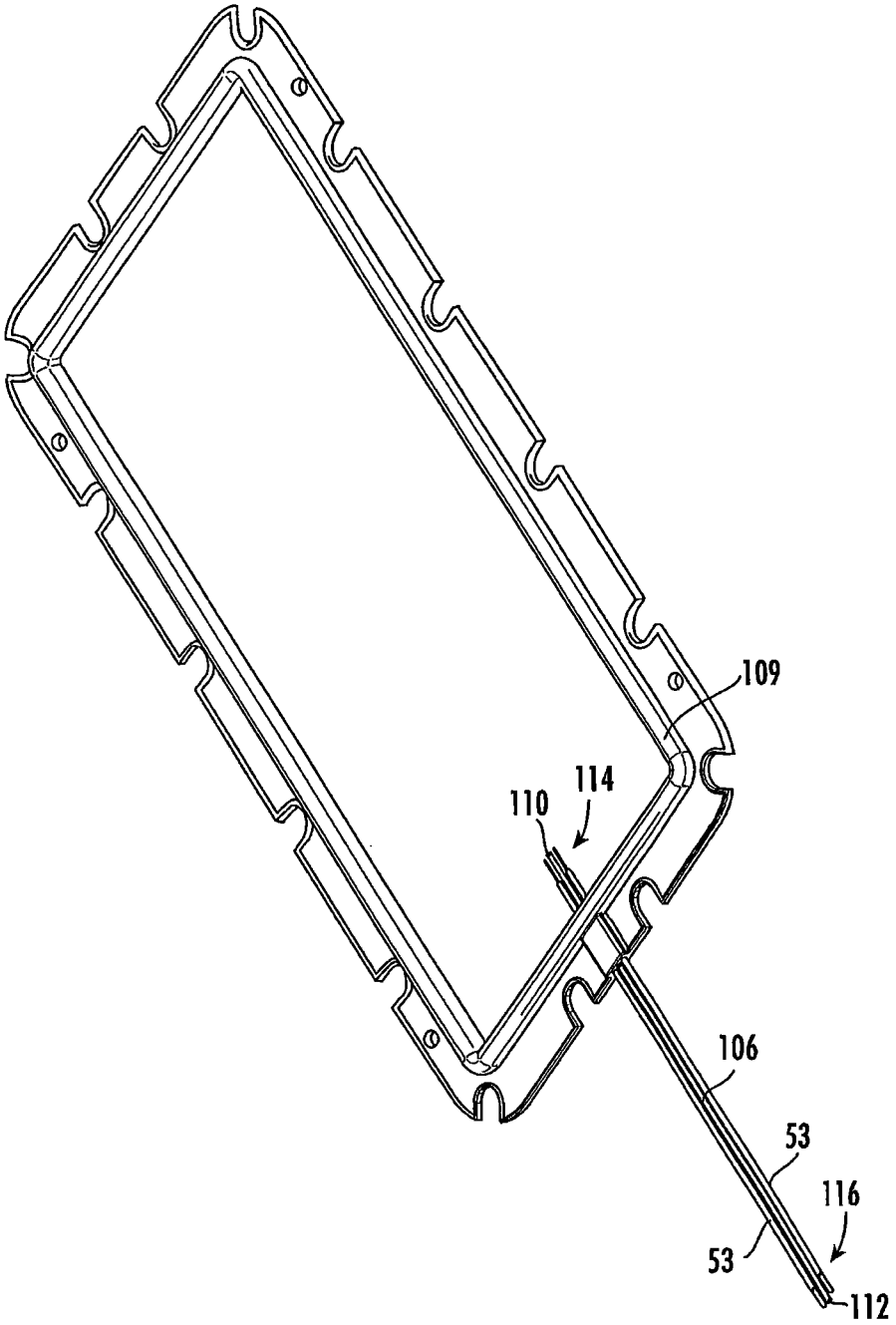
FIG. 10 is an isometric view of another embodiment of a gasket and gasket vent assembly for use with the luminaire of the previous FIGS. or another example luminaire.
Figure 11:
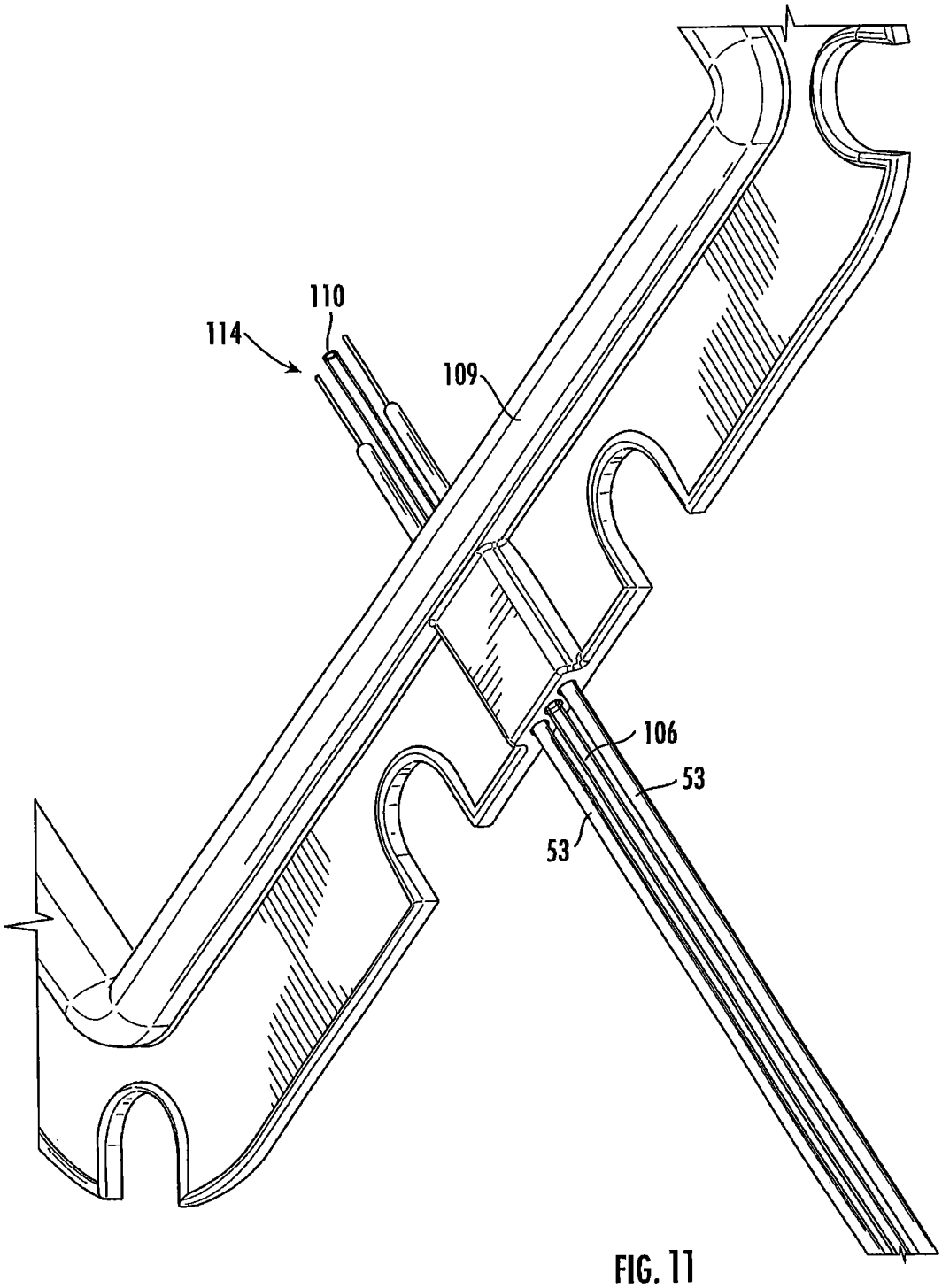
FIG. 11 is a partial enlarged isometric view of the gasket and gasket vent assembly shown in FIG. 10.
Figure 12:
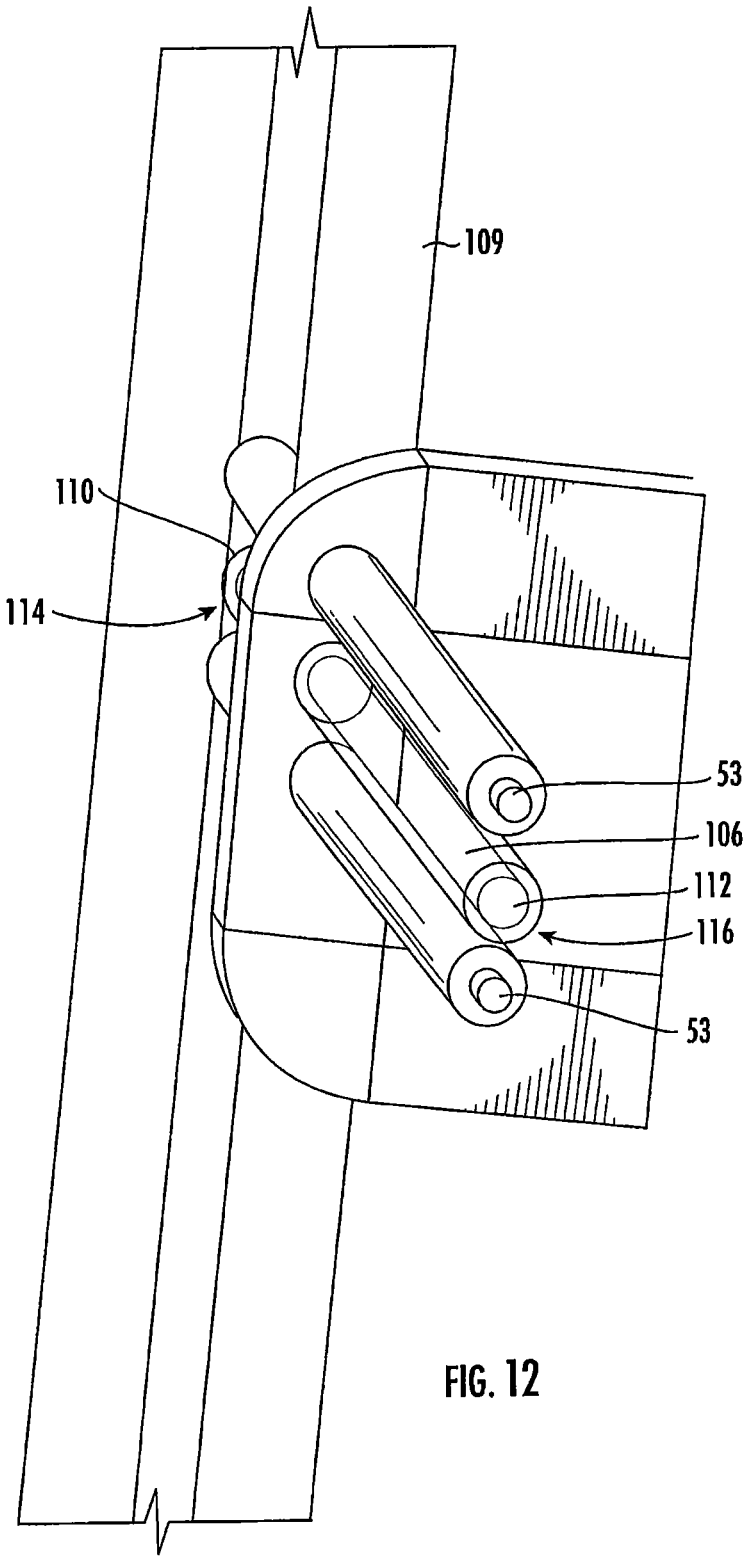
FIG. 12 is a partial enlarged isometric view of the gasket and gasket vent assembly shown in FIG. 10 from another angle.
Figure 13:
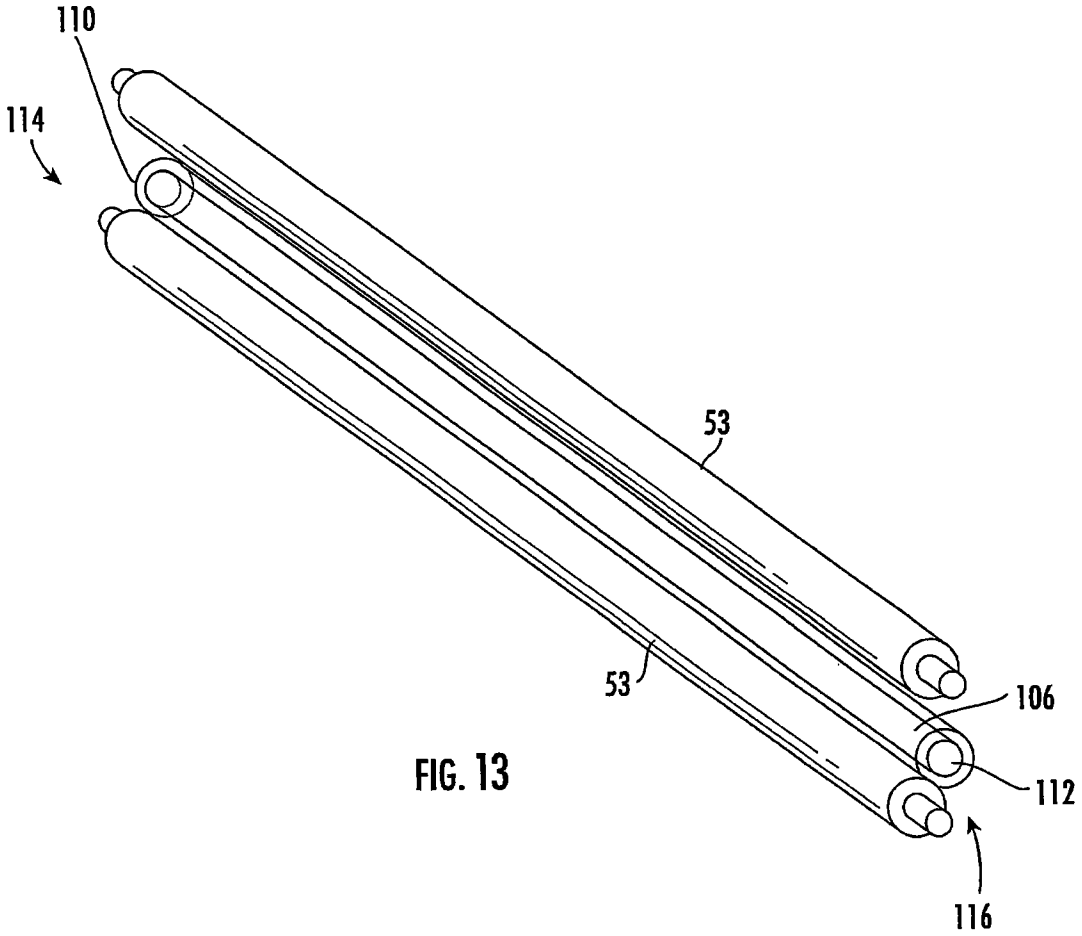
FIG. 13 is an isometric view of a tube and wires forming a portion of the gasket and gasket vent assembly shown in FIGS. 7-12.

Referring to FIGS. 10-12, an alternative configuration for a gasket 109, tube 106, and gasket vent 104, is shown. In these FIGS. the gasket 109 has a rectangular shape as an alternative to the circular or oval shape of the gasket 108 as shown in FIGS. 7 and 9. The gasket 109 may comprise a rectangular shape in order to accommodate a differently shaped optical member and/or a differently shaped luminaire.

Figure 14A:
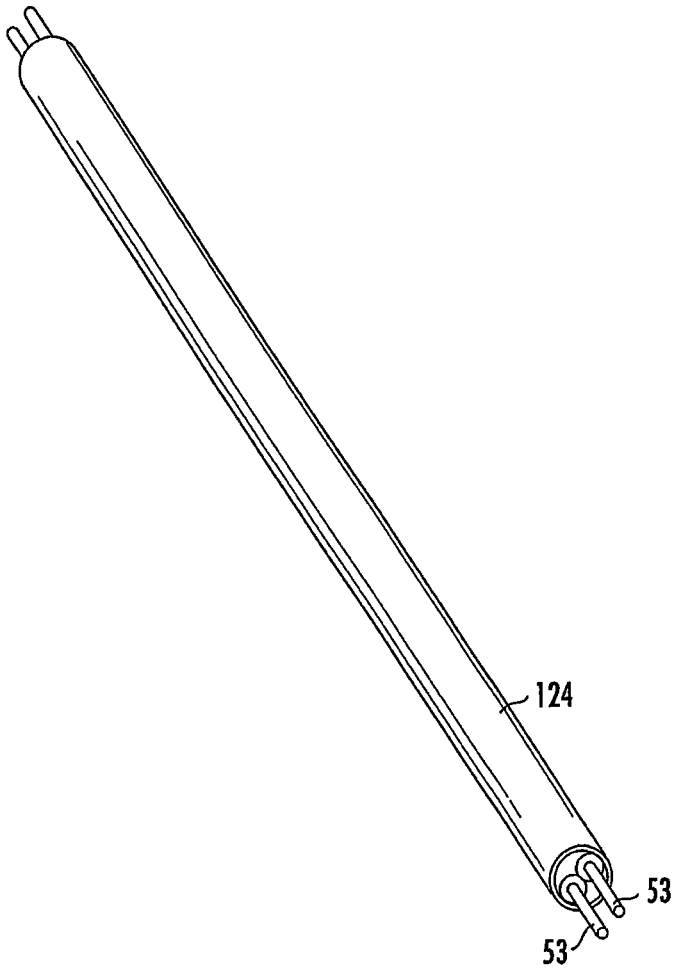
FIG. 14A is an isometric view of a tube and wires forming a portion of another embodiment of a gasket vent assembly for use with the luminaire of the previous FIGS. or another example luminaire.
Figure 14B:
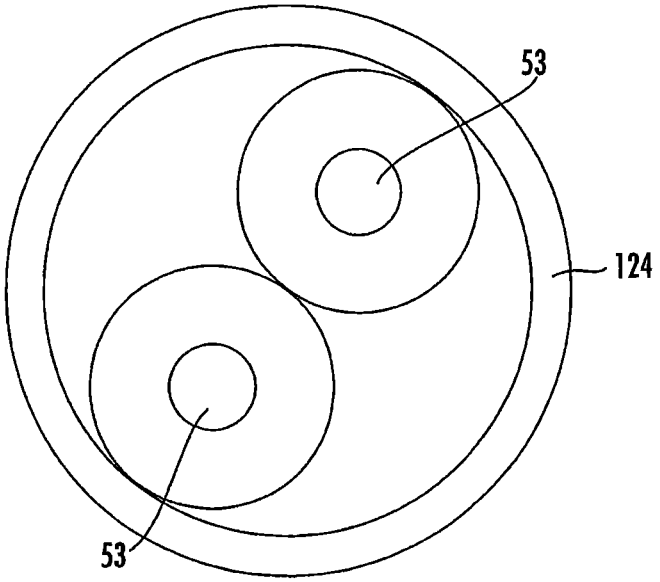
FIG. 14B is an end elevational view of the tube and wires depicted in FIG. 14.

According to a further example embodiment, the wires 53 may be housed within a relatively large, hollow tube 124, as seen in FIGS. 14A and 14B. The wires 53 pass through the tube 124, which in turn passes through a gasket 126 (FIGS. 15A-15C), similar to the gasket 108 shown in FIGS. 7-12, to form a gasket vent 127. In this example embodiment, UV curable silicone adhesive or another suitable material is poured about the interior perimeter 102 of the housing 54 while the combined wire and venting tube 124 is disposed along and within the channel 57 formed in the housing 54. The UV curable silicone adhesive surrounds the tube 124 and seals about the tube 124 with the wires 53 passing therethrough.

The tube 124 is configured to be small enough that the gasket 126 fully surrounds and seals about the tube 124, but large enough that the wires 53 easily pass through the tube 124 while providing for additional space within the tube 124 to allow the ready flow of air therethrough and around the wires 53 disposed therein. Thus, the tube 124 comprises a gasket vent 127. In this example embodiment, the wires 53 may be twisted or side-by-side, so long as sufficient space is left within the tube 124 to allow for air flow adequate for temperature and pressure equalization. Similar to the embodiment of FIGS. 5-8, a first end 138 of the tube 124 extends into the volume 100, specifically, the compartment between the optical member 56 and the housing 54, and the wires 53 protruding from the first end 138 are operatively coupled with the LED package 52 (FIGS. 2 and 7). The same wires 53 protrude from a second end 140 of the tube 124 within the volume 118 interior to the cover 205 and are operatively coupled to the circuit board 55 (FIG. 2) located outside of the optical member 56 and disposed inside the housing 54 of the luminaire 50 and protected by the cover 205 thereof. Thus, the gasket vent 127 both accommodates air flow between the first and second volumes/compartments 100, 118 and provides for the wires 53 to connect the LED package 52 with the circuit board 55.

Figure 15A:
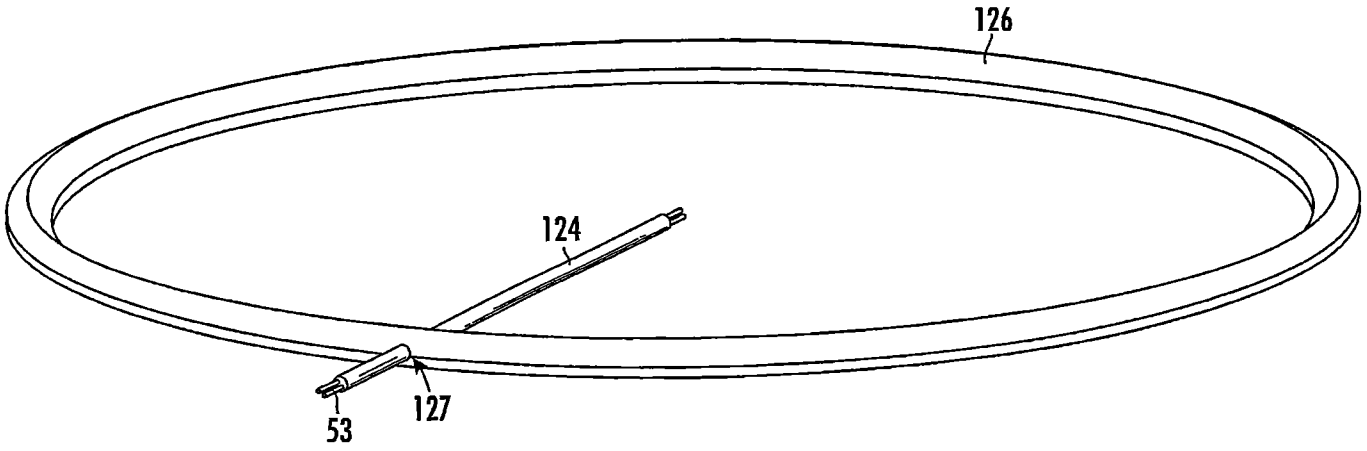
FIG. 15A is an isometric view of a gasket and gasket vent assembly comprising the tube and wires of FIGS. 14A and 14B further including a secondary tube.
Figure 15B:
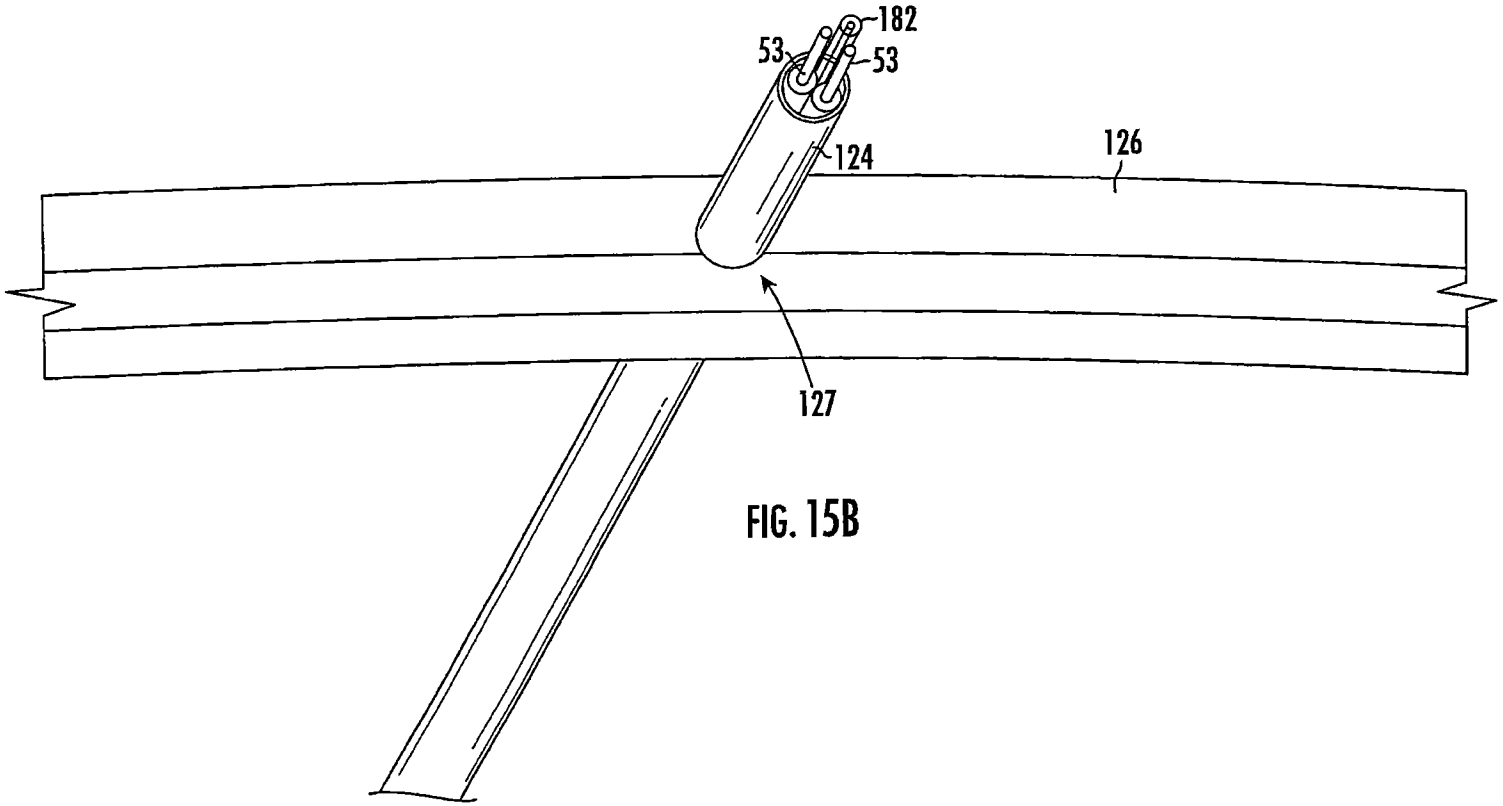
FIG. 15B is a partial enlarged isometric view of the gasket and gasket vent assembly of FIG. 15A.
Figure 15C:
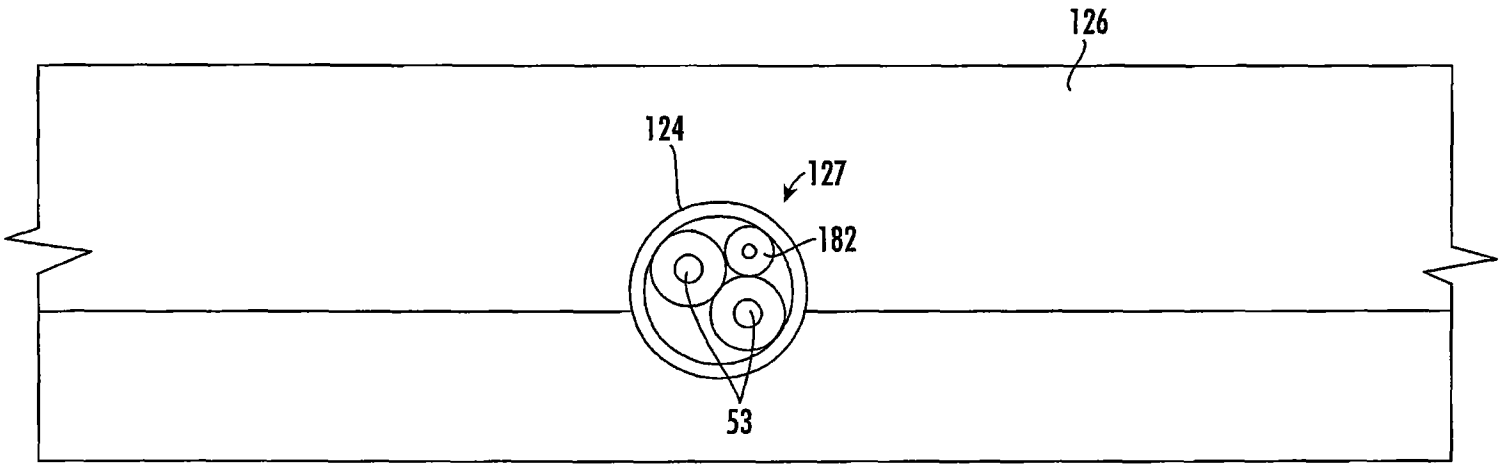
FIG. 15C is a partial enlarged end elevational view of the gasket and gasket vent assembly of FIG. 15A.

FIGS. 15A-15C depict the tube 124 disposed within the gasket 126 and further including a secondary tube 182. The secondary tube 182, along with the wires 53, passes through the tube 124. The secondary tube 182 may provide another path through which air may pass additional or alternative to the space around the wires 53 within the tube 124. The secondary tube 182 may allow air flow should the tube 124 become blocked and/or over-filled by the wires 53 and/or other components disposed therein.

Figure 16:
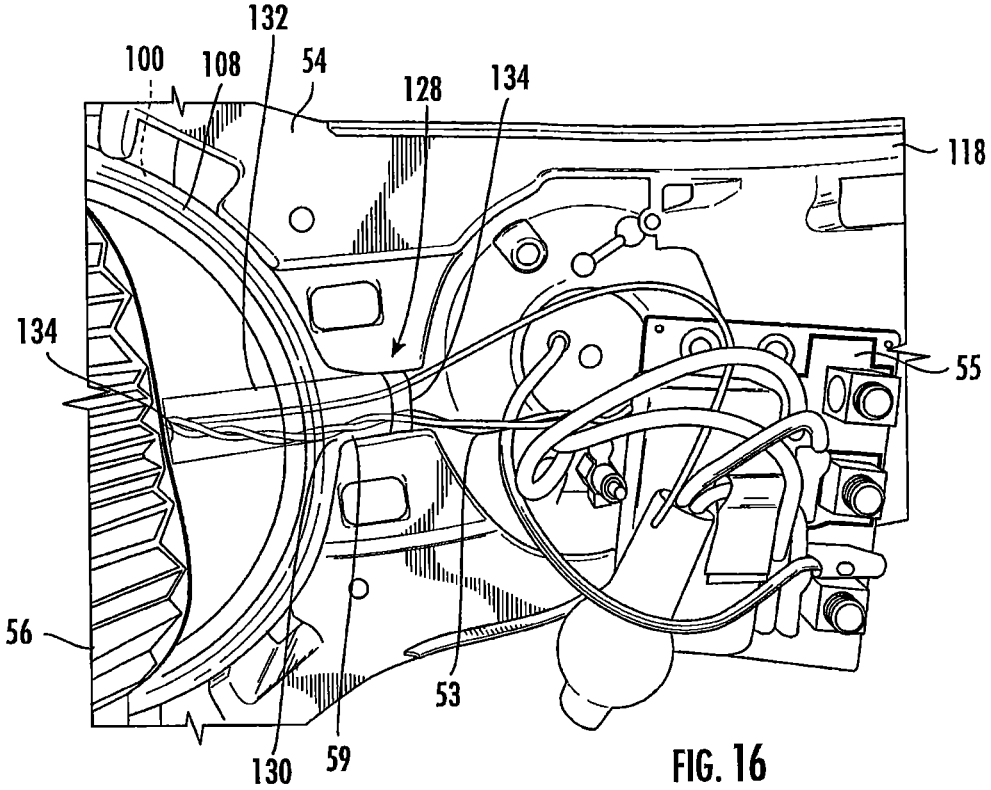
FIG. 16 is a partial perspective view of a gasket and gasket vent assembly for use with the luminaire of the previous FIGS. or another example luminaire.
Figure 17:
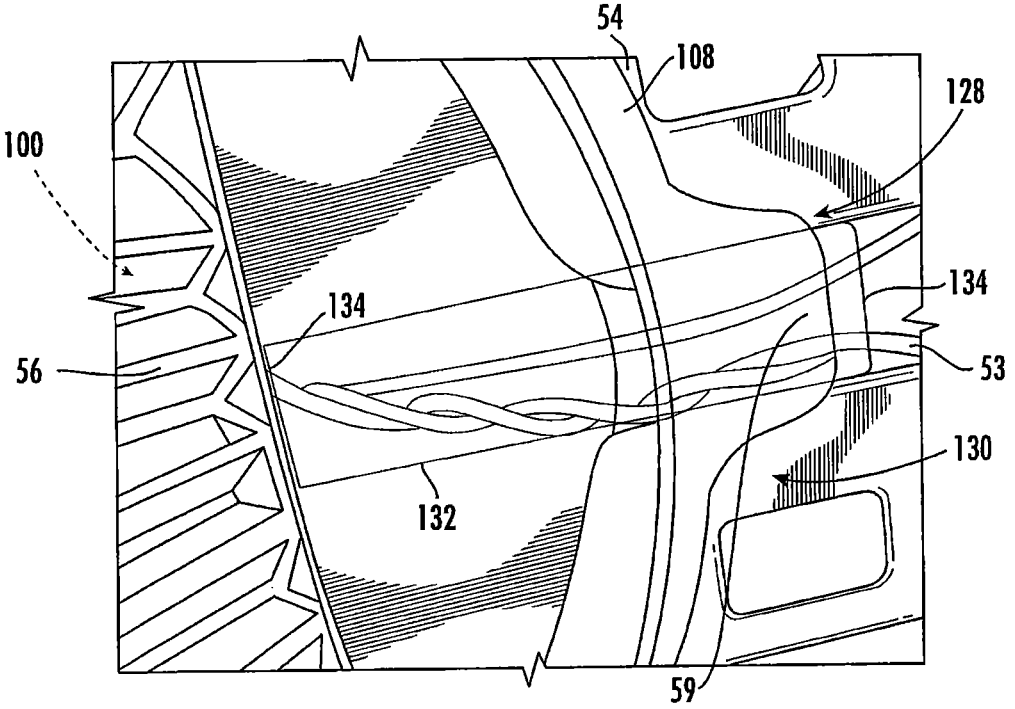
FIG. 17 is a partial enlarged perspective view of the gasket and gasket vent assembly shown in FIG. 16.
Figure 18:
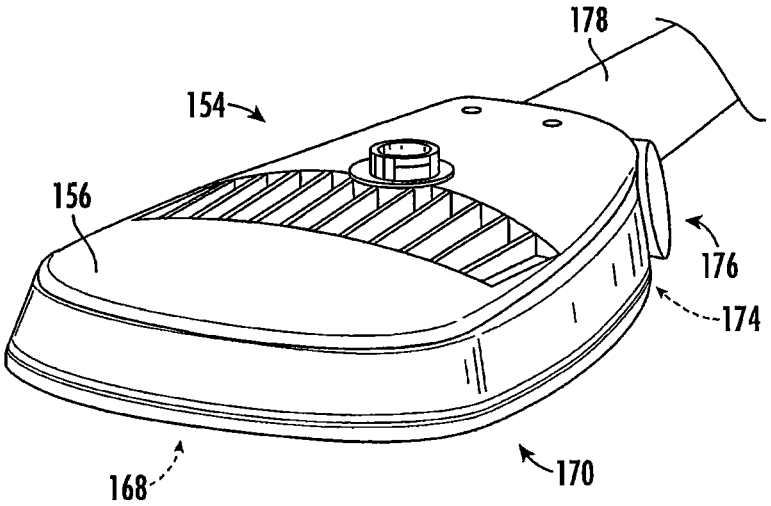
FIG. 18 is a fragmentary isometric view taken from above of another luminaire incorporating an optical member.
Figure 19:
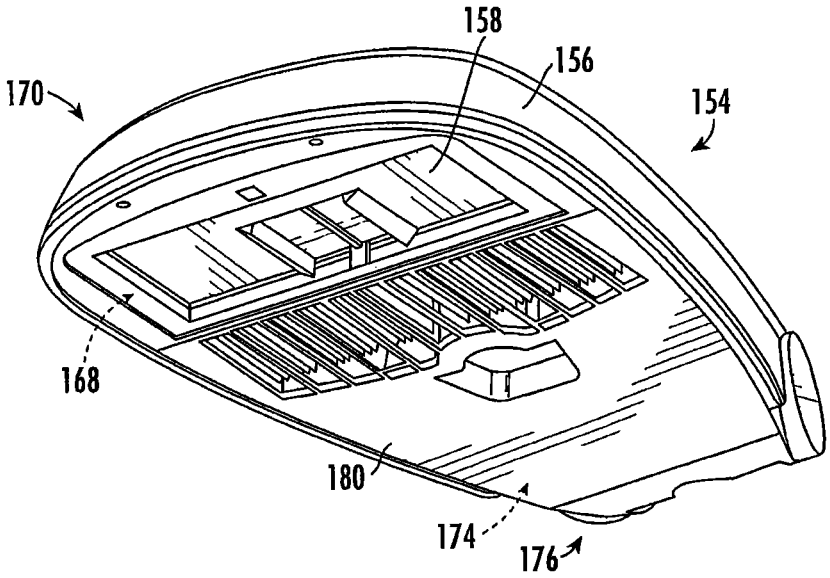
FIG. 19 is an isometric view taken from below of the luminaire shown in FIG. 18.

Referring now to FIGS. 16 and 17, in another example embodiment, the assembly of the luminaire 50, including the application of the UV curable silicone adhesive to form the gasket 108, may take place before formation of a gasket vent 128 through the gasket 108. According to this embodiment, the gasket 108 may form a weather-proof, water-tight, and/or air-tight seal about the volume 100 within the optical member 56 and the housing 54. The gasket material seals about the wires 53 and additional gasket material is exposed next to the wires 53 and under the tab 59. A portion 130 of the gasket material may be pierced in order to provide the gasket vent 128 therethrough. A hollow tube 132 may be inserted through the portion 130 of the gasket material adjacent the wires 53 such that a first end 134 of the tube 132 is disposed within the volume 100, formed by the compartment between the optical member 56 and the housing 54, while a second end 136 is disposed within another compartment of the luminaire 50, such as the volume/compartment 118 underneath the cover 205. The tube 132 forms the gasket vent 128 through which air is exchanged between the volume 100 and another location open to the changing temperature and weather conditions of the outside environment. In this example embodiment, the gasket material may self-seal around the tube 132 and/or a bead of secondary room temperature vulcanization (RTV) silicone may be dispensed proximal the point on the gasket 108 through which the tube 132 pierces. To facilitate piercing of the gasket 108, the tube 132 may be cut at one end thereof so as to form a point having sufficient sharpness for penetrating the gasket material. Then the tube 132 pierces the gasket 108 with the sharp point thereof. Alternatively, another sharpened tube, similar to a hollow needle such as might be used in medical catheterization procedures, may pierce the gasket 108 so that the tube 132 may then be inserted therethrough before or after withdrawal of the hollow needle.

In the example embodiments discussed hereinabove, the tube(s) 106, 124, 132 forming the gasket vent(s) 104, 127, 128 extend part way into the volume 100 as well as part way into the second volume 118 so that moisture and/or other undesirable environmental elements do not enter, pass through, or block the gasket vent(s) 104, 127, 128 even though air is exchanged thereby. The tube(s) 106, 124, 132 may be clipped to the housing 54 and/or cover 205 at the first and/or second ends thereof 114, 116, 138, 140, 134, 136, respectively, and/or otherwise secured to the housing 54, cover 205, and/or optical member or may be left free. According to another embodiment more than one tube may traverse the gasket 108 to provide venting. Additionally, the tube 106 may be variable in length, however, a particular length may be desirable so that the ends 114, 116 thereof do not permit water, dust, and/or other debris, which may be present near the seal formed by the gasket 108, to enter the tube 106 and pass into the volume 100. In further example embodiments, the tube(s) 106, 124, and/or 132 may be disposed elsewhere around a perimeter of the gasket 108 to form one or more gasket vents 104 therethrough. The tube(s) 106, 124, and/or 132 may be formed from acrylic, glass, plastic, steel, aluminum, and/or another suitable material or combination of materials. The tube(s) 106, 124, and/or 132 may be curved, straight, and/or comprise curved and/or straight sections.

Figure 20:
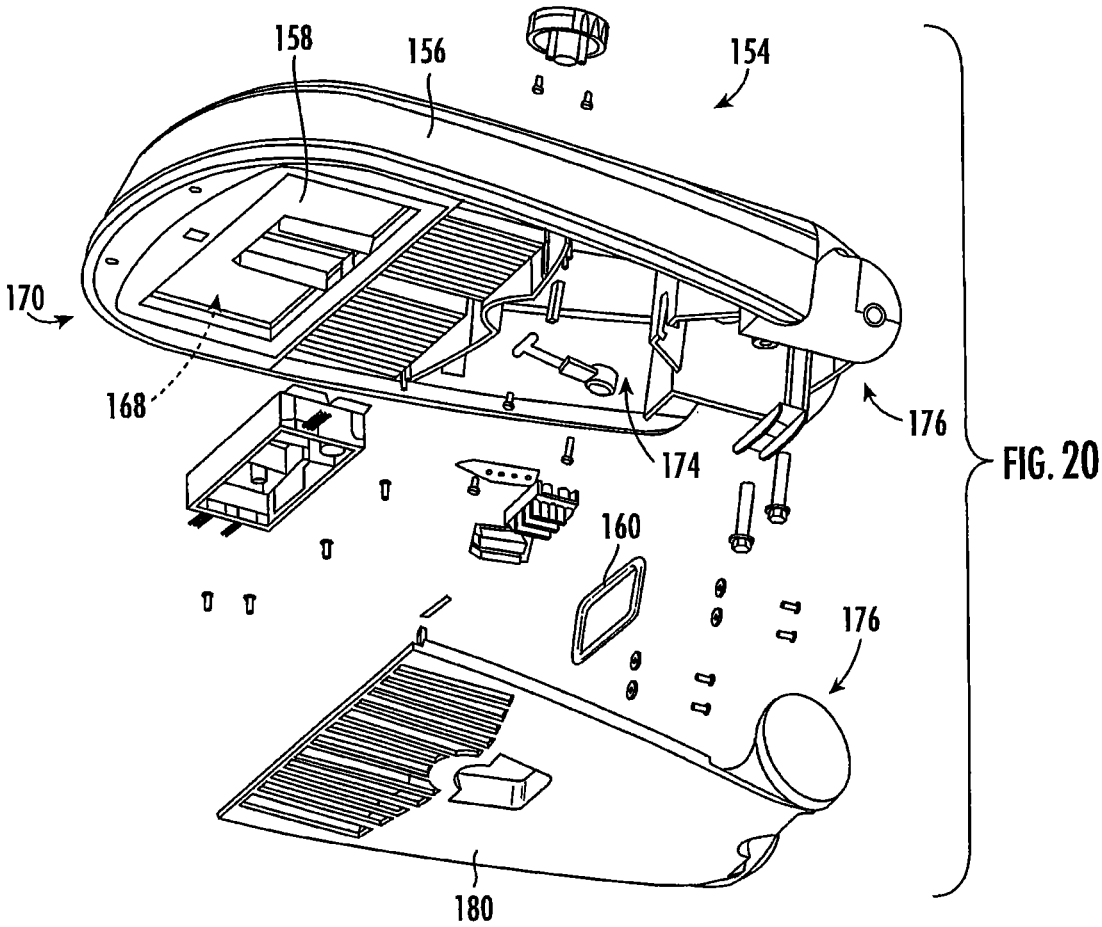
FIG. 20 is an exploded isometric view of the luminaire shown in FIG. 18 showing a gasket.
Figure 21:
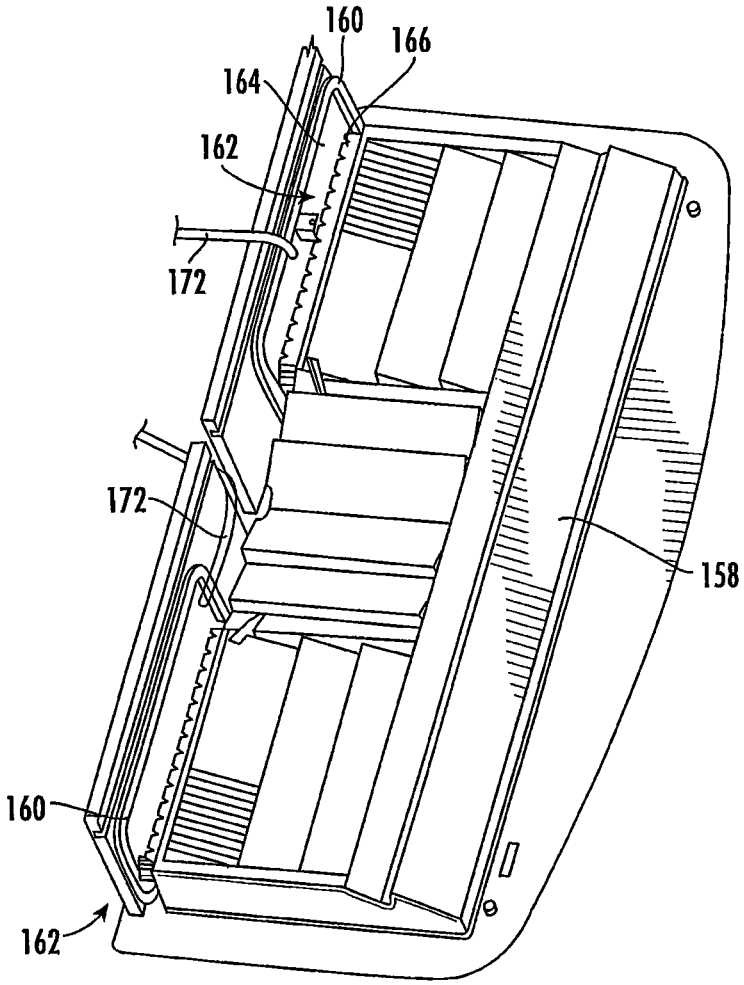
FIG. 21 is partial enlarged isometric view of the optical member and gasket(s) within the luminaire shown in FIG. 18.

Referring now to FIGS. 18-21, a gasket vent 152, similar to the gasket vent 104 described hereinabove with reference to FIGS. 5-15, may be formed in a luminaire 154 having a different assembly. The luminaire 154 depicted in FIGS. 18 and 19, may be of the type disclosed in U.S. patent application Ser. No. 14/485,609, filed Sep. 12, 2014, entitled "Luminaire Utilizing Waveguide", owned by the assignee of the present application, and the disclosure of which is hereby incorporated by reference herein. The luminaire 154 has a housing 156 with an optical member 158 (FIG. 2) disposed therein. As shown in FIGS. 20 and 21, a gasket 160 may be disposed about an opening 162 of the housing 156 such that one or more gasket(s) 160 seal one or more PCB(s) 164 carrying one or more LED module(s) 166 within the opening 162 and adjacent the optical member 158 thereby forming a volume/compartment 168 within a head end 170 of the luminaire 154. One or more tube(s) 172 may traverse the one or more gasket(s) 160 (FIG. 21) to provide air exchange between the volume 168 and another compartment of the luminaire 154, such as a volume 174 within a cover 180 inside a mounting end 176, for mounting the luminaire 154 to a post 178, thereof. Alternatively, the one or more tube(s) 172 may traverse a different portion of the housing 156, optical member 158, and/or the one or more PCB(s) 164. Further, as with previously described embodiments, the one or more tube(s) 172 may vary in length in order to reach particular distances into the associated volumes 168, 174 of the luminaire 154.

Further, the gasket vent(s) 104, 127, 128, 152 described hereinabove may be utilized with variations of the luminaires 50, 154 and/or with different luminaires having different configurations. The gasket vent(s) 104, 152 may be used with luminaires of the type(s) disclosed in U.S. patent application Ser. No. 14/485,609, filed Sep. 12, 2014, entitled "Luminaire Utilizing Waveguide", the disclosure of which is incorporated by reference hereinabove, U.S. patent application Ser. No. 14/657,988, filed Mar. 13, 2015, entitled "Luminaire Utilizing Waveguide", U.S. Design Patent application Ser. No. 29/496,754, filed Jul. 16, 2014, entitled "Roadway Luminaire", U.S. patent application Ser. No. 15/060,354, filed Mar. 3, 2016, entitled "Luminaire Utilizing Waveguide", U.S. patent application Ser. No. 15/060,306, filed Mar. 3, 2016, entitled "Luminaire Utilizing Light Emitting Diodes", and/or U.S. patent application Ser. No. 15/192,979, filed Jun. 24, 2016, entitled "Luminaire Utilizing Optical Waveguide", all owned by the assignee of the present application, and the disclosures of which are hereby incorporated by reference herein. According to these methods and configurations, tubes or other structures used for formation of gasket vents may be different shapes and/or lengths customizable for application to particular luminaires and appropriately mounted therein by clips, adhesives, and/or other attachment mechanisms. Additionally, gasket vent (s) consistent with the present disclosure may be adapted for use with LED luminaires having different shapes from the luminaires of the above-noted patent applications. Specifically, the gasket venting methods and configurations herein may be used with ceiling troffers, parking garage luminaires, LED bulb-style luminaires, and/or other LED luminaires comprising one or more weather-proofed compartment/volume.

Any of the embodiments disclosed herein may include a power circuit having a buck regulator, a boost regulator, a buck-boost regulator, a SEPIC power supply, or the like, and may comprise a driver circuit as disclosed in U.S. patent application Ser. No. 14/291,829, filed May 30, 2014, entitled "High Efficiency Driver Circuit with Fast Response" by Hu et al. or U.S. patent application Ser. No. 14/292,001, filed May 30, 2014, entitled "SEPIC Driver Circuit with Low Input Current Ripple" by Hu et al. incorporated by reference herein. The circuit may further be used with light control circuitry that controls color temperature of any of the embodiments disclosed herein in accordance with viewer input such as disclosed in U.S. patent application Ser. No. 14/292,286, filed May 30, 2014, entitled "Lighting Fixture Providing Variable CCT" by Pope et al. incorporated by reference herein.

Further, any of the embodiments disclosed herein may be used in a luminaire having one or more communication components forming a part of the light control circuitry, such as an RF antenna that senses RF energy. The communication components may be included, for example, to allow the luminaire to communicate with other luminaires and/or with an external wireless controller, such as disclosed in U.S. patent application Ser. No. 13/782,040, filed Mar. 1, 2013, entitled "Lighting Fixture for Distributed Control" or U.S. Provisional Application No. 61/932,058, filed Jan. 27, 2014, entitled "Enhanced Network Lighting" both owned by the assignee of the present application and the disclosures of which are incorporated by reference herein. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such sensor may be integrated into the light control circuitry.

INDUSTRIAL APPLICABILITY

In summary, the disclosed luminaire provides an aesthetically pleasing, sturdy, cost effective lighting assembly for use in lighting a large area such as a parking lot or deck of a parking garage and/or along a roadway. The lighting is accomplished with reduced glare as compared to conventional lighting systems. Further, one or more volume(s)/compartment(s) within the luminaire(s) described herein are vented such that air exchange prevents damage from pressure and temperature differentials between such volume(s) and the environment surround the luminaire(s). Furthermore, the one or more volume(s) vented according to the techniques contemplated by this disclosure retain weatherproof qualities. The venting methods and arrangements contemplated herein are compatible with IP66 (Ingress Protection) weather-proofing/enclosure standards and other applicable industry standards.

The light redirection features and indentation disclosed herein efficiently redirect light out of the optic. At least some of the luminaires disclosed herein are particularly adapted for use in outdoor or indoor general illumination products (e.g., streetlights, high-bay lights, canopy lights, parking lot or parking structure lighting, yard or other property lighting, rural lighting, walkway lighting, warehouse, store, arena or other public building lighting, or the like). According to one aspect the luminaires disclosed herein are adapted for use in products requiring a total lumen output of between about 1,000 and about 12000 lumens or higher, and, more preferably, between about 4,000 and about 10,000 lumens and possibly higher, and, most preferably, between about 4,000 and about 8,000 lumens. According to another aspect, the luminaires develop at least about 2000 lumens. Further, efficacies between about 75 and about 140 lumens per watt, and more preferably between about 80 and about 125 lumens per watt, and most preferably between about 90 and about 120 lumens per watt can be achieved. Still further, the luminaires disclosed herein preferably have a color temperature of between about 2500 degrees Kelvin and about 6200 degrees Kelvin, and more preferably between about 2500 degrees Kelvin and about 5000 degrees Kelvin, and most preferably between about 3500 degrees Kelvin and about 4500 degrees Kelvin. Further, the optical efficiency may range from about 70% to about 95%, most preferably from about 80% to about 90%. A color rendition index (CRI) of between about 70 and about 80 is preferably attained by at least some of the luminaires disclosed herein, with a CRI of at least about 70 being more preferable. Any desired particular output light distribution, such as a butterfly light distribution, could be achieved, including up and down light distributions or up only or down only distributions, etc.

When one uses a relatively small light source which emits into a broad (e.g., Lambertian) angular distribution (common for LED-based light sources), the conservation of etendue, as generally understood in the art, requires an optical system having a large emission area to achieve a narrow (collimated) angular light distribution. In the case of parabolic reflectors, a large optic is thus generally required to achieve high levels of collimation. In order to achieve a large emission area in a more compact design, the prior art has relied on the use of Fresnel lenses, which utilize refractive optical surfaces to direct and collimate the light. Fresnel lenses, however, are generally planar in nature, and are therefore not well suited to re-directing high-angle light emitted by the source, leading to a loss in optical efficiency. In contrast, in the present disclosure, light is coupled into the optic, where primarily TIR is used for redirection and collimation. This coupling allows the full range of angular emission from the source, including high-angle light, to be re-directed and collimated, resulting in higher optical efficiency in a more compact form factor.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the subject matter of this disclosure are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only and should not be taken as limiting the scope of the disclosure.

What is claimed is:

1. A device for venting a luminaire compartment, comprising:

a luminaire compartment disposed between a housing and an optical member;

one or more luminaire gaskets comprising an adhesive disposed between the housing and the optical member for attaching the optical member to the housing and for maintaining a weather-proof seal about the luminaire compartment; and one or more venting tubes traversing at least one of the one or more luminaire gaskets;

wherein the one or more venting tubes extend into the luminaire compartment such that the one or more venting tubes equalize one or more environmental parameters of the luminaire compartment with one or more environmental parameters of the ambient environment.

2. The device of claim 1, wherein the one or more venting tubes extend into a second luminaire compartment that is open to the ambient environment.

3. The device of claim 1, wherein the adhesive comprises a curable polymer.

4. The device of claim 1, wherein air passes through the one or more venting tubes to equalize pressure within the luminaire compartment.

5. The device of claim 1, wherein the one or more venting tubes comprise a first venting tube and a second venting tube disposed within the first venting tube.

6. The device of claim 5, wherein one or more electrical components are disposed within the first venting tube.

7. The device of claim 6, wherein air passes through one or both of the first venting tube and the second venting tube.

8. A method for providing a vent for a more luminaire compartment, comprising:

positioning a weather-proof gasket about a compartment of a luminaire a disposed between a housing and an optical member for attaching the optical member to the housing, wherein the one or more weather-proof gasket prevents environmental debris from entering the compartment;

forming a tube comprising a pointed end;

piercing the weather-proof gasket with the pointed end of the one tube and inserting the tube through the weather-proof gasket, wherein the tube remains disposed through the weather-proof gasket after piercing therethrough;

and providing passage of air to and from the compartment through the tube so that environmental conditions in the compartment are adjusted adjust to ambient environmental conditions.

9. The method of claim 8, wherein the weather-proof gasket is formed from a curable polymer.

10. The method of claim 8, wherein the tube communicates with a second compartment that is open to the ambient environmental conditions; and wherein air passes between the compartment and the second compartment through the at least tube to adjust the compartment to the ambient environmental conditions.

11. The method of claim 8, further comprising arranging other luminaire components to pass through the tube.

12. The method of claim 11, wherein the other luminaire components comprise one or more electrical wires.

13. The method of claim 11, wherein the other luminaire components comprise a venting tube for passing air between the one or more luminaire compartments.

14. A system for weather-proofing a light fixture, comprising:

a gasket formed from a curable polymer dispensed about a perimeter of a first volume within a light fixture, the first volume being formed of a housing and an optical member, the gasket attaching the optical member to the housing; and one or more tubes and one or more electrical components disposed across the perimeter of the first volume about which the curable polymer is dispensed, the one or more tubes and one or more electrical components being surrounded by and held in position by the curable polymer;

wherein the one or more tubes extend into the first volume and into a second volume wherein the second volume comprises ambient environmental conditions; and wherein the one or more tubes extend a length out from the gasket such that a likelihood that an opening of the one or more tubes encounters environmental debris is decreased.

15. The system of claim 14, wherein the second volume is a compartment of the light fixture that is partially protected from the ambient environmental conditions.

16. The system of claim 15, wherein the one or more tubes extend sufficiently into the second volume that the opening of the one or more tubes is at least partially protected from environmental debris.

17. The system of claim 16, wherein the one or more tubes allow air passage between the first volume and the second volume.

18. A system for weather-proofing a luminaire, comprising:

a gasket formed from curable polymer dispensed about a perimeter of a first volume within the luminaire disposed between a housing and an optical member for attaching the optical member to the housing; and a tube disposed across the perimeter of the first volume about which the curable polymer is dispensed;

one or more luminaire components disposed within the tube, the one or more luminaire components traversing the gasket through the tube, and wherein the one or more luminaire components comprise a second tube; and wherein conditions within the first volume are equalized with the ambient environmental conditions by passage of air through the tube and about at least one of the one or more luminaire components disposed therein and by the passage of air through the second tube.

19. The system of claim 18, wherein the one or more luminaire components comprise electrical wires.

* * * * *